US009995303B2

(12) United States Patent
Ikeda et al.

(10) Patent No.: US 9,995,303 B2
(45) Date of Patent: Jun. 12, 2018

(54) AIR CONDITIONER

(71) Applicant: Mitsubishi Electric Corporation, Tokyo (JP)

(72) Inventors: Takashi Ikeda, Tokyo (JP); Mitsuhiro Shirota, Tokyo (JP); Takehiro Hayashi, Tokyo (JP); Yoshitaka Yamaguchi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 480 days.

(21) Appl. No.: 14/646,077

(22) PCT Filed: Nov. 19, 2013

(86) PCT No.: PCT/JP2013/081150
§ 371 (c)(1),
(2) Date: May 20, 2015

(87) PCT Pub. No.: WO2014/080899
PCT Pub. Date: May 30, 2014

(65) Prior Publication Data

US 2015/0292508 A1 Oct. 15, 2015

(30) Foreign Application Priority Data

Nov. 22, 2012 (WO) ..... PCT/JP2012/080332

(51) Int. Cl.

| | |
|---|---|
| ***F01D 5/22*** | (2006.01) |
| ***F04D 17/04*** | (2006.01) |
| ***F04D 29/28*** | (2006.01) |
| ***F04D 29/30*** | (2006.01) |
| ***F04D 29/68*** | (2006.01) |

(Continued)

(52) U.S. Cl.
CPC ..... *F04D 17/04* (2013.01); *F04D 29/283* (2013.01); *F04D 29/30* (2013.01); *F04D 29/665* (2013.01);

(Continued)

(58) Field of Classification Search
CPC ..... F04D 29/283; F04D 17/04

(Continued)

(56) References Cited

U.S. PATENT DOCUMENTS 8,029,242 B2 * 10/2011 Teraoka ..... F04D 17/04 416/223 R
9,303,649 B2 * 4/2016 Ikeda ..... F24F 1/0025

(Continued)

FOREIGN PATENT DOCUMENTS

CN 102128172 A 7/2011
JP 09-126190 A 5/1997

(Continued)

OTHER PUBLICATIONS

Office Action dated Jul. 4, 2016 issued in corresponding CN patent application No. 201380066183.0 (and English translation).

(Continued)

*Primary Examiner* — Logan Kraft
*Assistant Examiner* — Jason Fountain
(74) *Attorney, Agent, or Firm* — Posz Law Group, PLC

(57) ABSTRACT

A cross-flow fan includes an impeller and a shaft. The impeller includes a plurality of support plates and a plurality of blades. The blades are different in a blade cross section orthogonal to an impeller rotational axis, and each have a plurality of regions arranged in a direction of the impeller rotational axis and a coupling portion formed so as to couple the plurality of regions to each other. A rib is formed on the coupling portion, or formed in a region adjacent to the coupling portion within a range separated away from the coupling portion by up to 20% of a length of the region adjacent to the coupling portion in the rotational axis direction.

14 Claims, 19 Drawing Sheets

(51) Int. Cl.
*F24F 1/00* (2011.01)
*F04D 29/66* (2006.01)

(52) U.S. Cl.
CPC ..... *F04D 29/681* (2013.01); *F24F 1/0007* (2013.01); *F24F 1/0025* (2013.01); *F24F 2001/0048* (2013.01)

(58) Field of Classification Search
USPC ..... 416/178
See application file for complete search history.

(56) References Cited

U.S. PATENT DOCUMENTS

| | | | | |
|---|---|---|---|---|
| 9,447,791 | B2 * | 9/2016 | Aschermann | F04D 29/384 |
| 2007/0253834 | A1 | 11/2007 | Ogino et al. | |
| 2014/0102676 | A1 * | 4/2014 | Tadokoro | F04D 17/04 165/121 |

FOREIGN PATENT DOCUMENTS

| | | | |
|---|---|---|---|
| JP | 10-077989 | A | 3/1998 |
| JP | 2006-329100 | A | 12/2006 |
| JP | 2011-122522 | A | 6/2011 |
| JP | 2011-196387 | A | 10/2011 |
| JP | 4896213 | B | 1/2012 |

OTHER PUBLICATIONS

International Search Report of the International Searching Authority dated Feb. 25, 2014 for the corresponding international application No. PCT/JP2013/081150 (and English translation).
Extended European Search Report dated Jul. 1, 2016 in the corresponding EP application No. 13856078.4.
Office action dated Oct. 2, 2017 corresponding to EP patent application No. 13856078.4.

* cited by examiner

AIR CONDITIONER

CROSS REFERENCE TO RELATED APPLICATIONS

This application is a U.S. national stage application of International Patent Application No. PCT/JP2013/081150 filed on Nov. 19, 2013, and is based on International Patent Application No. PCT/JP2012/080332 filed on Nov. 22, 2012, the contents of which are incorporated herein by reference.

TECHNICAL FIELD

The present invention relates to an air conditioner having a cross-flow fan, which is used as blower means, mounted thereon.

BACKGROUND ART

In Patent Literature 1, there is disclosed a cross-flow fan including an impeller. The impeller includes at least two support plates arranged at an interval in a rotational axis direction, and a plurality of blades arranged between the two support plates at intervals in a circumferential direction of the support plate. In this cross-flow fan, in a blade cross section orthogonal to the rotational axis of the impeller, the plurality of blades have substantially the same outer diameter. Further, in this cross-flow fan, when the longitudinal length of the blade is divided into a plurality of regions, in other words, when the longitudinal length of the blade is divided into a first region corresponding to a part adjacent to the support plate, a second region corresponding to a blade ring center portion, and a third region corresponding to a part between the first region and the second region, a blade outlet angle at a blade outer peripheral end portion in each region is increased in the order of (second region)<(first region)<(third region).

Further, in Patent Literature 2, there is disclosed a cross-flow fan including a plurality of ribs each extending from a blade leading edge portion along a blade suction surface.

Further, in Patent Literature 3, there is disclosed a transverse fan including blades each formed of a convex-shaped metal thin plate. On the convex-shaped surface, a plurality of rectangular cut and erected pieces are formed so as to erect in the convex direction. Those cut and erected pieces are arranged side by side at predetermined pitches in the blade axial direction.

CITATION LIST

Patent Literature

[PTL 1] JP 4896213 B2 (page 7, [0024], [0025], and FIG. 7)

[PTL 2] JP 2006-329100 A (page 3, [0017], and FIG. 1)

[PTL 3] JP 10-77989 A (page 4, [0037], and FIG. 6)

SUMMARY OF INVENTION

Technical Problems

However, in the configuration disclosed in Patent Literature 1, a flow in an impeller rotational axis direction (blade longitudinal direction) is formed on a surface of a connection portion between the regions at which the blade outlet angle changes. The flow becomes unstable when the operation state changes due to accumulation of dust on a filter, for example. Thus, a backward flow may occur from an air outlet toward the fan.

Further, in the configuration disclosed in Patent Literature 2, when the rib is shaped to protrude from the blade outer peripheral end to the outside of the impeller, or the rib end portion is formed extremely thin, there arises a problem in that the workability during fan cleaning is unsatisfactory. Further, when an upstream end portion of the rib has a flat surface, the inflow current is curled up at the flat surface, and along therewith, the surrounding flow is also curled up. Thus, the flow in a blade chord direction (direction orthogonal to the impeller rotational axis) at the blade suction surface is disturbed, and thus the air blowing efficiency may be deteriorated. Further, when dust adheres to the filter or the like to cause a high load due to the deterioration of the air blowing efficiency, a flow is liable to separate from the blade surface, which may cause an unstable flow to increase the noise.

Further, in the configuration disclosed in Patent Literature 3, when a metal-piece rib is formed extremely thin, there arises a problem in that the workability during fan cleaning is unsatisfactory. Further, after the rib is formed, a hole remains in a part corresponding to the rib before bending of the blade surface. Therefore, deterioration in noise due to the turbulence of the flow passing through the hole and deterioration in air blowing efficiency due to reduction in pressure rise on the blade surface may be caused.

The present invention has been made in view of the above, and has an object to provide a cross-flow fan and an air conditioner that are capable of reducing the noise and increasing the air blowing efficiency.

Solution to Problem

In order to attain the above-mentioned object, according to one embodiment of the present invention, there is provided a cross-flow fan, including: an impeller; and a shaft for supporting the impeller in a rotatable manner, the impeller including: a plurality of support plates; and a plurality of blades arranged at intervals in a circumferential direction between a corresponding pair of the support plates, the blade including a plurality of regions different in a blade cross section orthogonal to an impeller rotational axis, the plurality of regions being arranged in a direction of the impeller rotational axis in the blade, the blade further including a coupling portion for coupling the plurality of regions to each other, the blade including at least one rib formed on the coupling portion or formed in a region adjacent to the coupling portion within a range separated away from the coupling portion by up to 20% of a length of the region adjacent thereto in the direction of the impeller rotational axis.

Further, in order to attain the above-mentioned object, according to one embodiment of the present invention, there is provided an air conditioner, including: a stabilizer for partitioning an inlet-side air duct and an outlet-side air duct inside a main body; a cross-flow fan arranged between the inlet-side air duct and the outlet-side air duct; a ventilation resistor arranged inside the main body; and a guide wall for guiding air discharged from the cross-flow fan to an air outlet of the main body, the cross-flow fan being the above-mentioned cross-flow fan according to the one embodiment.

Advantageous Effects of Invention

According to the one embodiment of the present invention, it is possible to reduce the noise and increase the air blowing efficiency.

DESCRIPTION OF EMBODIMENT

Figure 1:
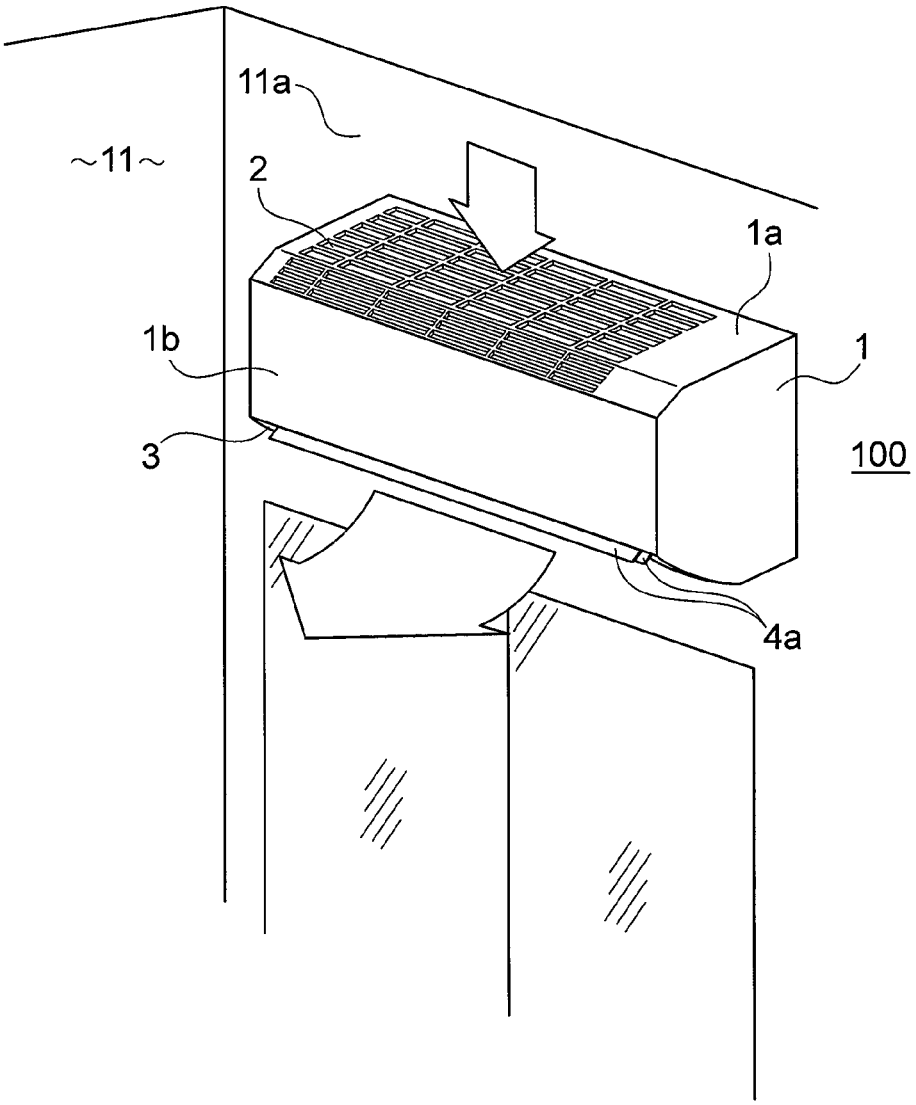
FIG. 1 is a view illustrating an installing state of an air conditioner according to a first embodiment of the present invention when viewed from the interior of a room.

Now, an air conditioner according to an embodiment of the present invention is described with reference to the accompanying drawings. Note that, in the drawings, the same reference symbols represent the same or corresponding parts.

First Embodiment

Figure 2:
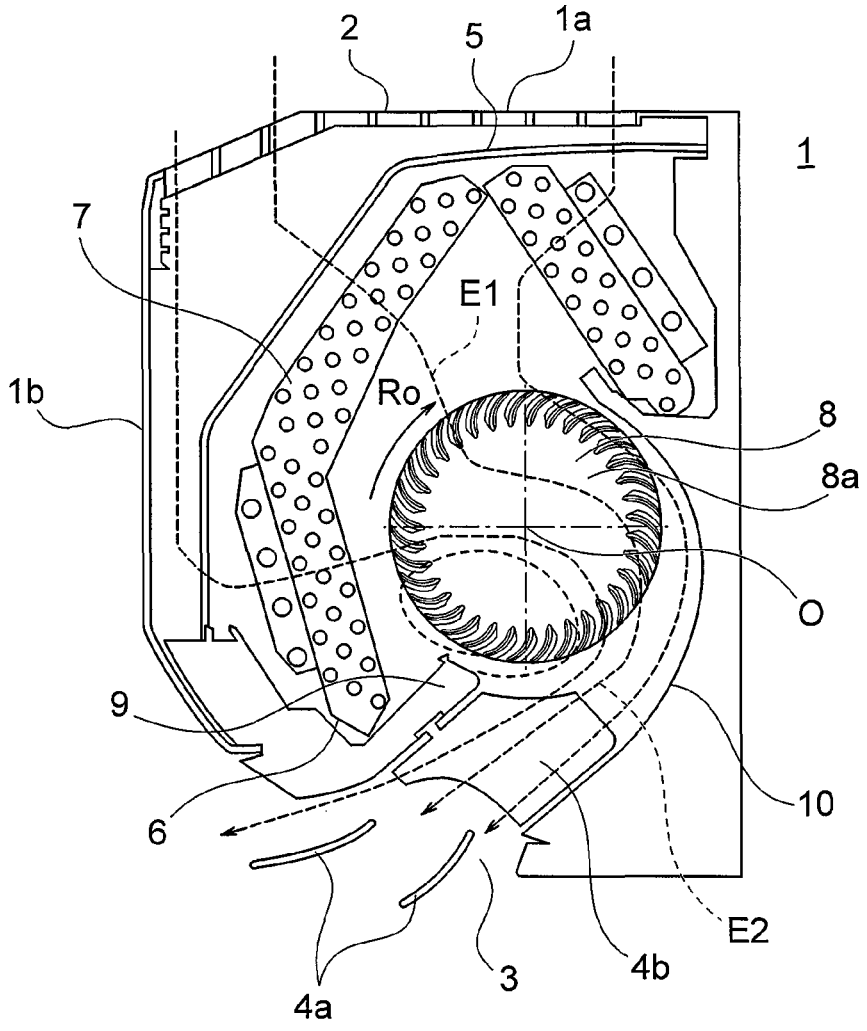
FIG. 2 is a vertical sectional view of the air conditioner of FIG. 1.
Figure 3:
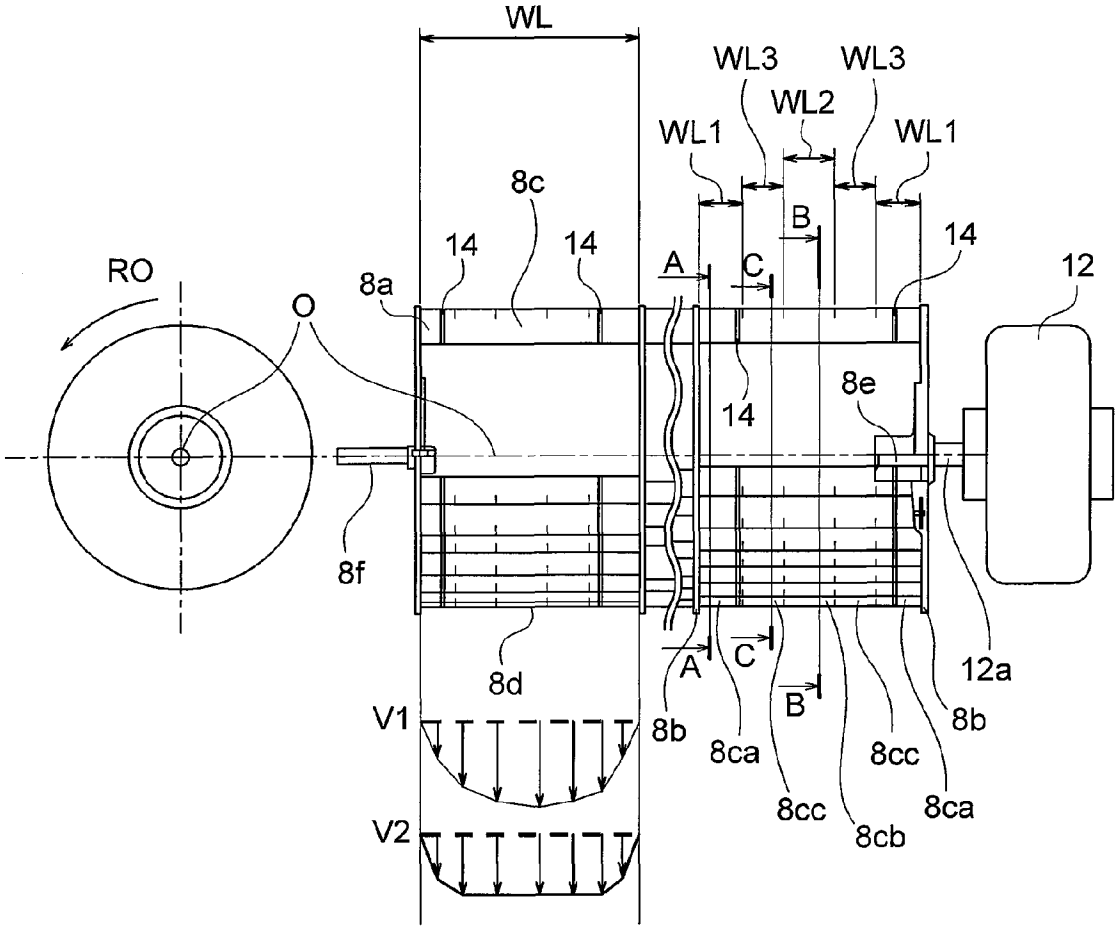
FIG. 3 is a front view of an impeller of a cross-flow fan to be mounted on the air conditioner of FIG. 1.
Figure 4:
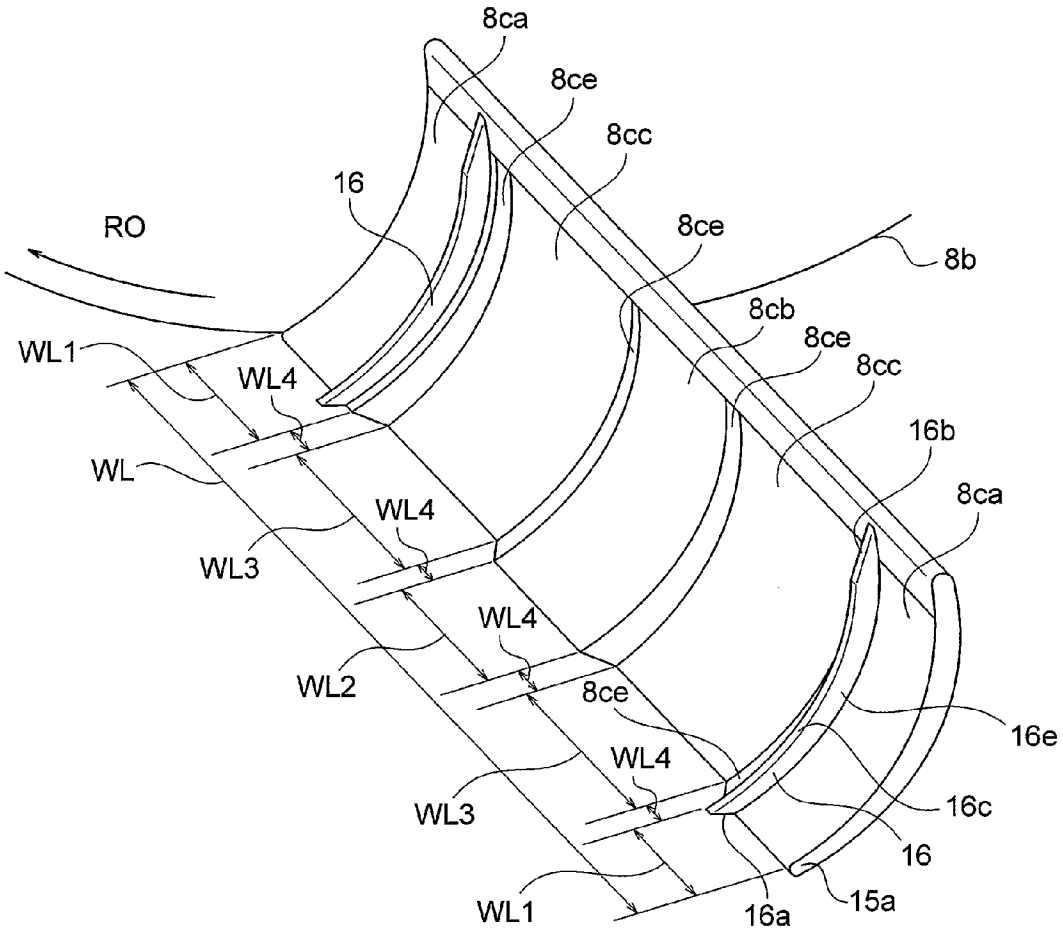
FIG. 4 is a perspective view of a single blade of the impeller of the cross-flow fan when viewed from a surface on an impeller rotational direction side (blade pressure surface).
Figure 5:
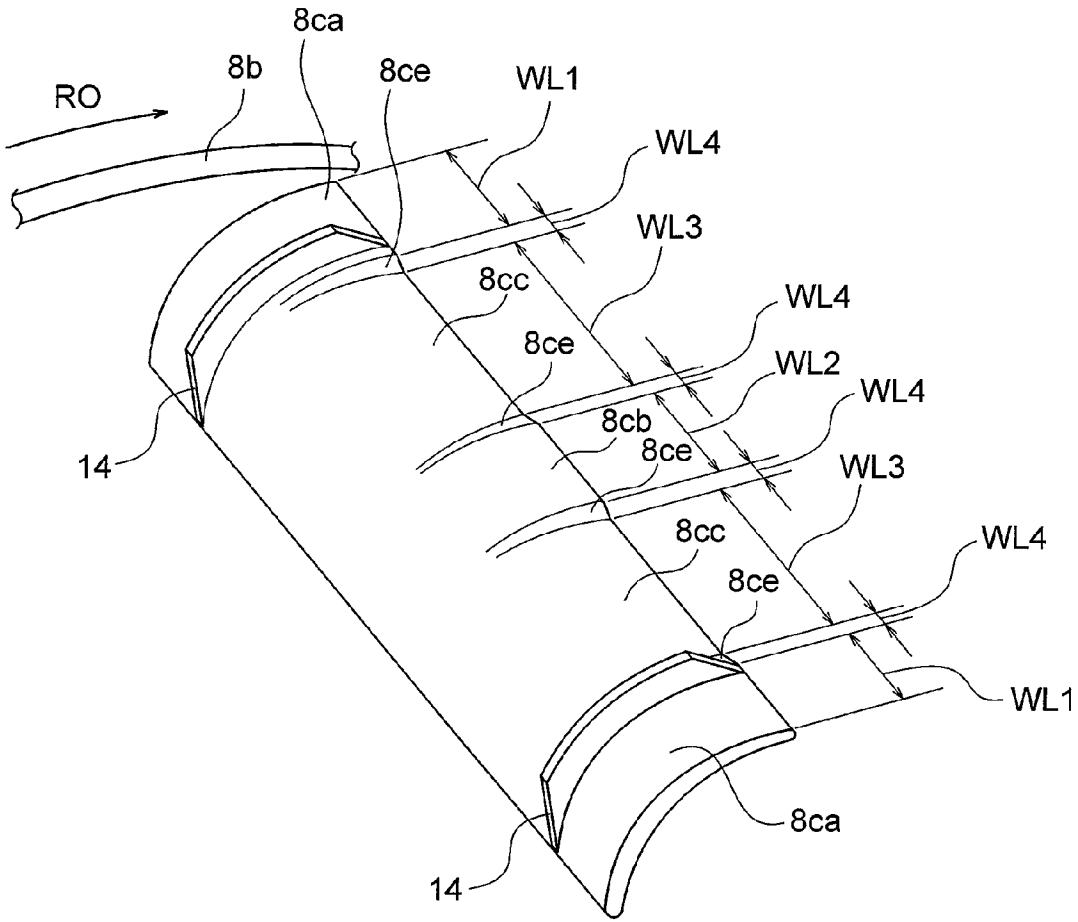
FIG. 5 is a perspective view of the single blade of the impeller when viewed from a surface on an opposite side to the impeller rotational direction side (blade suction surface).

FIG. 1 is an installation schematic view of an air conditioner having a cross-flow fan mounted thereon according to a first embodiment of the present invention when viewed from a room. FIG. 2 is a vertical sectional view of the air conditioner of FIG. 1. FIG. 3 is a front part sectional view of an impeller of the cross-flow fan to be mounted on the air conditioner of FIG. 1. FIG. 4 is a schematic perspective view of a state of a single blade of the impeller of the cross-flow fan of FIG. 3, which is viewed from a blade pressure surface 13*a* side when the single blade is positioned in an outlet-side air duct (impeller outlet region) E2. FIG. 5 is a schematic perspective view of a state of the single blade of the impeller of the cross-flow fan of FIG. 3, which is viewed from a blade suction surface 13*b* side when the single blade is positioned in an inlet-side air duct (impeller inlet region) E1.

As illustrated in FIG. 1, an air conditioner (indoor unit) 100 includes a main body 1 and a front panel 1*b* installed on the front side of the main body 1, which form an outer shape of the air conditioner 100. In this case, in FIG. 1, the air conditioner 100 is installed on a wall 11*a* of a room 11 that is a space to be air-conditioned. That is, FIG. 1 illustrates the air conditioner 100 of a wall-mounting type as an example, but the present invention is not limited to this mode. For example, a ceiling concealed type may be employed. Further, the air conditioner 100 is not limited to be installed in the room 11, and may be installed in a room of a building or a storehouse, for example.

As illustrated in FIG. 2, in a main body upper portion la forming the upper portion of the main body 1, a suction grille 2 for sucking air inside the room into the air conditioner 100 is formed. On the lower side of the main body 1, an air outlet 3 for supplying the conditioned air into the room is formed, and further a guide wall 10 for guiding the air discharged from a cross-flow fan 8 (described later) to the air outlet 3 is formed.

As illustrated in FIG. 2, the main body 1 includes a filter (ventilation resistor) 5 for removing dust and the like in the air sucked through the suction grille 2, a heat exchanger (ventilation resistor) 7 for generating conditioned air by transferring hot or cold energy of refrigerant to air, a stabilizer 9 for partitioning the inlet-side air duct E1 and the outlet-side air duct E2, the cross-flow fan 8 arranged between the inlet-side air duct E1 and the outlet-side air duct E2, for sucking air through the suction grille 2 and blowing out air through the air outlet 3, and a vertical airflow-direction vane 4*a* and a lateral airflow-direction vane 4*b* for adjusting the direction of the air blown out from the cross-flow fan 8.

The suction grille 2 is an opening through which the air inside the room is forcibly introduced into the air conditioner 100 by the cross-flow fan 8. The suction grille 2 is formed as an opening in the upper surface of the main body 1. The air outlet 3 is an opening through which air, which has been sucked through the suction grille 2 and passed through the heat exchanger 7, passes when the air is supplied into the room. The air outlet 3 is formed as an opening in the front panel 1*b*. The guide wall 10 forms the outlet-side air duct E2 in cooperation with the lower surface side of the stabilizer 9. The guide wall 10 forms a helical surface from the cross-flow fan 8 toward the air outlet 3.

The filter 5 is formed into, for example, a mesh shape, for removing dust and the like in the air sucked through the suction grille 2. The filter 5 is mounted on the downstream side of the suction grille 2 and on the upstream side of the heat exchanger 7 in the air duct from the suction grille 2 to the air outlet 3 (center portion inside the main body 1).

The heat exchanger 7 (indoor heat exchanger) functions as an evaporator to cool the air during cooling operation, and functions as a condenser (radiator) to heat the air during heating operation. The heat exchanger 7 is mounted on the downstream side of the filter 5 and on the upstream side of the cross-flow fan 8 in the air duct from the suction grille 2 to the air outlet 3 (center portion inside the main body 1). Note that, in FIG. 2, the heat exchanger 7 is shaped so as to surround the front side and the upper side of the cross-flow fan 8. However, this shape is merely an example, and the present invention is not limited thereto.

The heat exchanger 7 is connected to an outdoor unit of a known mode including a compressor, an outdoor heat exchanger, an expansion device, and the like, to thereby construct a refrigeration cycle. Further, as the heat exchanger 7, for example, a cross-fin type fin-and-tube heat exchanger including a heat transfer tube and a large number of fins is used.

The stabilizer 9 partitions the inlet-side air duct E1 and the outlet-side air duct E2, and as illustrated in FIG. 2, the stabilizer 9 is mounted on the lower side of the heat exchanger 7. The inlet-side air duct E1 is positioned on the upper surface side of the stabilizer 9, and the outlet-side air duct E2 is positioned on the lower surface side of the stabilizer 9. The stabilizer 9 includes a drain pan 6 for temporarily accumulating dew condensation water adhering on the heat exchanger 7.

The cross-flow fan 8 sucks air inside the room through the suction grille 2 and blows out conditioned air through the air outlet 3. The cross-flow fan 8 is mounted on the downstream side of the heat exchanger 7 and on the upstream side of the air outlet 3 in the air duct from the suction grille 2 to the air outlet 3 (center portion inside the main body 1).

The cross-flow fan 8 includes, as illustrated in FIG. 3, an impeller 8*a* made of a thermoplastic resin such as an AS resin (styrene-acrylonitrile copolymer) with glass fibers, a motor 12 for rotating the impeller 8*a*, and a motor shaft 12*a* for transmitting the rotation of the motor 12 to the impeller 8*a*. The impeller 8*a* itself rotates to suck the air inside the room through the suction grille 2 and send the conditioned air to the air outlet 3. Note that, in FIG. 3, reference symbol V1 represents a related-art airflow velocity distribution, and reference symbol V2 represents an airflow velocity distribution of this embodiment.

The impeller 8*a* is formed by coupling a plurality of impeller elements 8*d* to each other, and each of the impeller elements 8*d* includes a plurality of blades 8*c* and at least one ring (support plate) 8*b* fixed to the end portion side of the plurality of blades 8*c*. That is, in the impeller element 8*d*, each of the plurality of blades 8*c* extends from a side surface of an outer peripheral portion of the disk-shaped ring 8*b* so as to be substantially orthogonal to the side surface. In addition, the plurality of blades 8*c* are arrayed at predetermined intervals in the circumferential direction of the ring 8*b*. The impeller 8*a* is integrated by welding and coupling the plurality of impeller elements 8*d* to each other as described above. Note that, the impeller encompasses a mode of including only a single impeller element.

The impeller 8*a* includes a fan boss 8*e* protruding on the inner (center) side of the impeller 8*a*. The fan boss 8*e* is fixed to the motor shaft 12*a* with a screw or the like. Further, in the impeller 8*a*, one side of the impeller 8*a* is supported by the motor shaft 12*a* via the fan boss 8*e*, and the other side of the impeller 8*a* is supported by a fan shaft 8*f*. With this, the impeller 8*a* rotates in a rotational direction RO about an impeller rotation center O of the impeller 8*a* under a state in which both end sides thereof are supported, which enables sucking of the air inside the room through the suction grille 2 and sending of the conditioned air through the air outlet 3. Note that, the impeller 8*a* is described in detail later.

The vertical airflow-direction vane 4*a* vertically adjusts the direction of the air blown out from the cross-flow fan 8, and the lateral airflow-direction vane 4*b* laterally adjusts the direction of the air blown out from the cross-flow fan 8. The vertical airflow-direction vane 4*a* is mounted on the downstream side with respect to the lateral airflow-direction vane 4*b*. Note that, the vertical direction herein corresponds to the vertical direction of FIG. 2, and the lateral direction herein corresponds to a front-back direction of the drawing sheet of FIG. 2.

Figure 6:
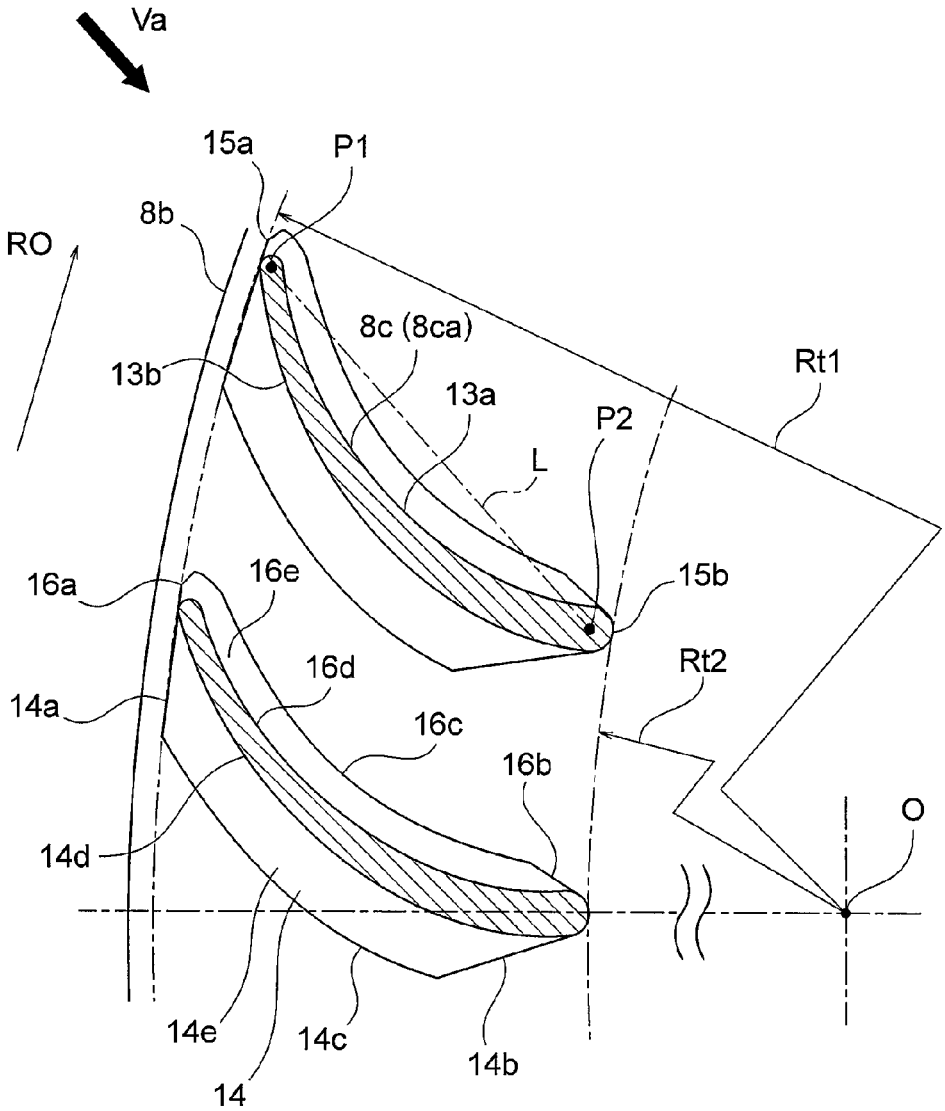
FIG. 6 is a sectional view of the blade of the cross-flow fan taken along the line A-A of FIG. 3.
Figure 7:
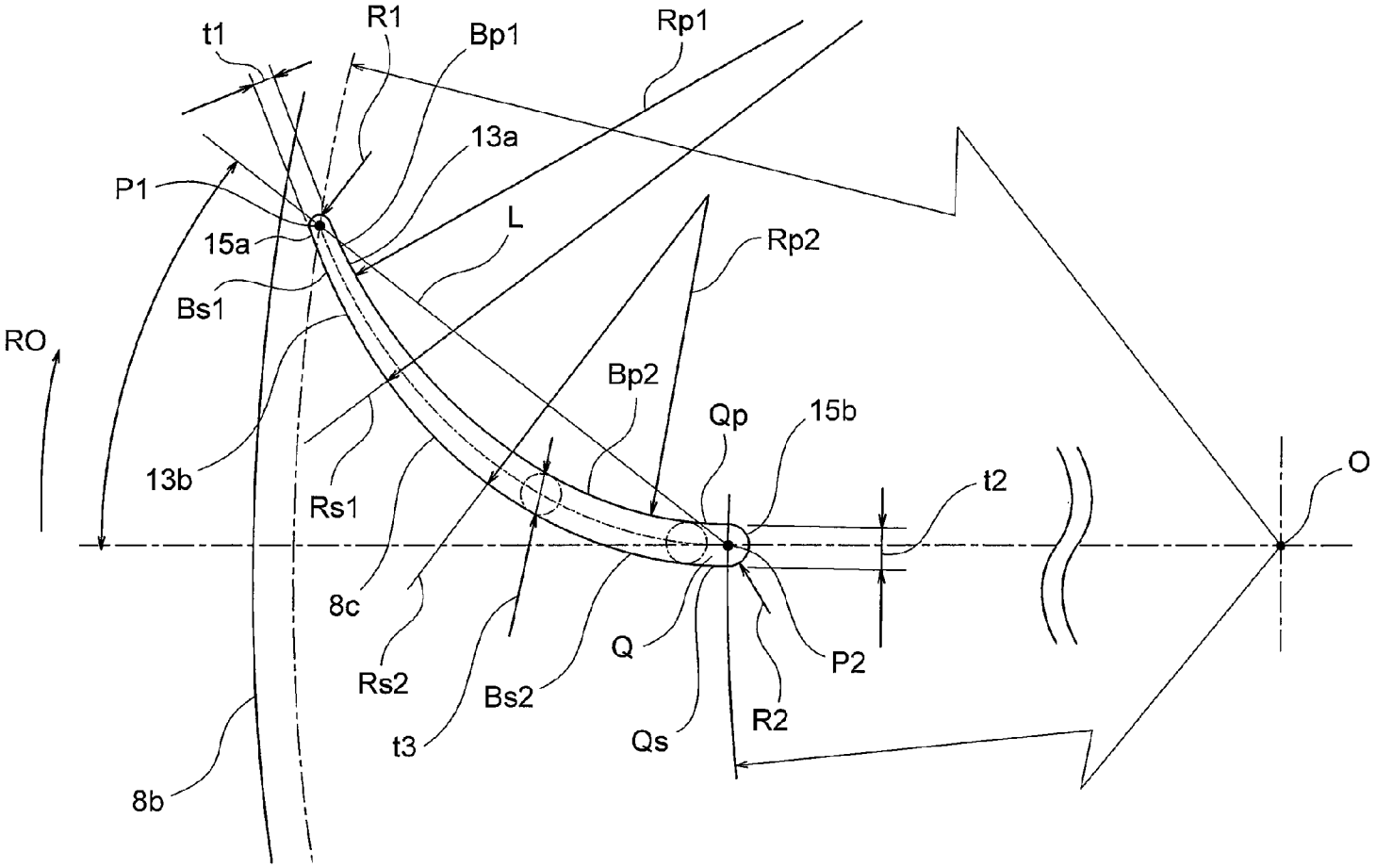
FIG. 7 is a sectional view of the blade of the cross-flow fan taken along the line C-C of FIG. 3.
Figure 8:
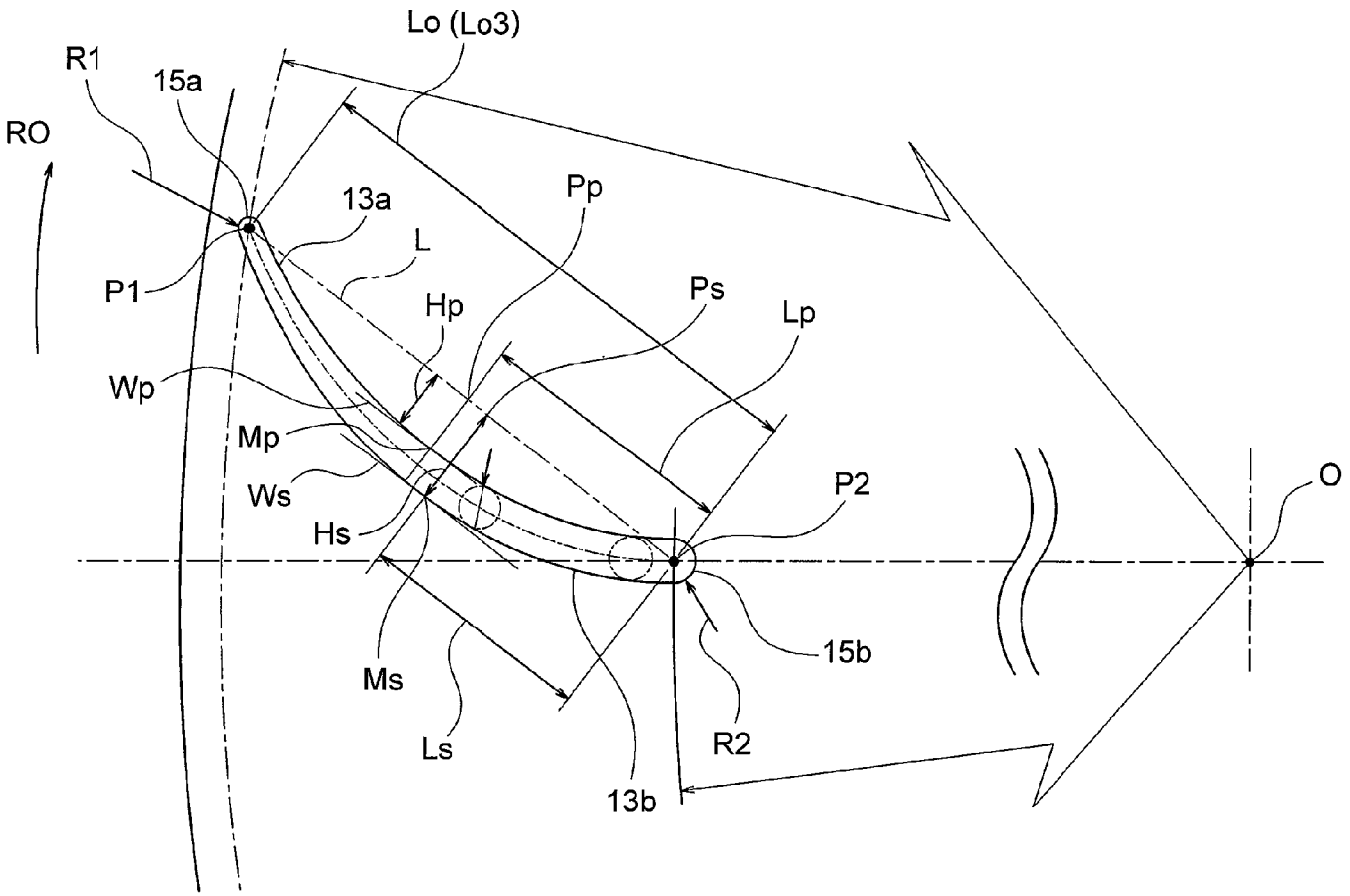
FIG. 8 is a sectional view of the blade of the cross-flow fan taken along the line C-C of FIG. 3.
Figure 9:
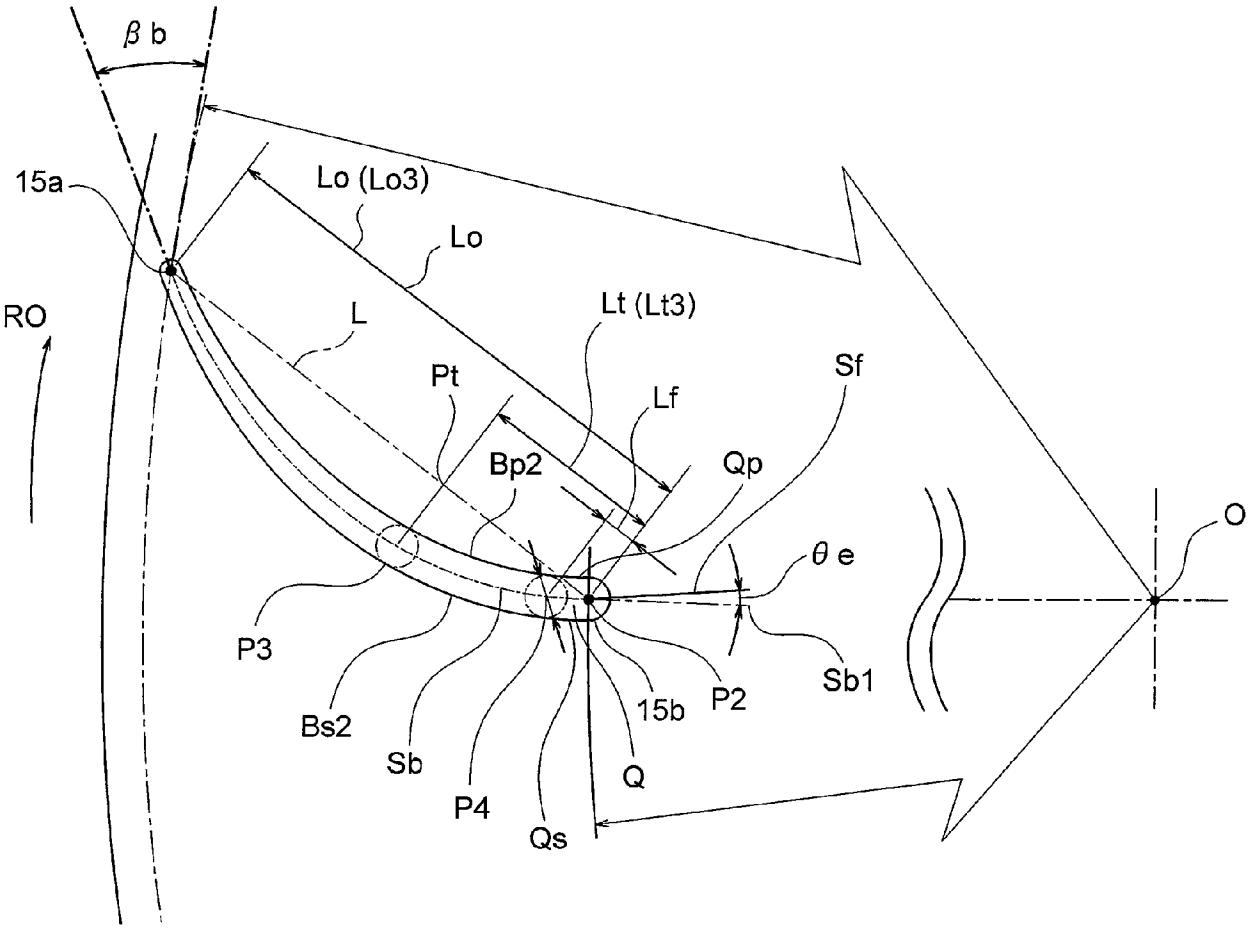
FIG. 9 is a sectional view of the blade of the cross-flow fan taken along the line C-C of FIG. 3.
Figure 10:
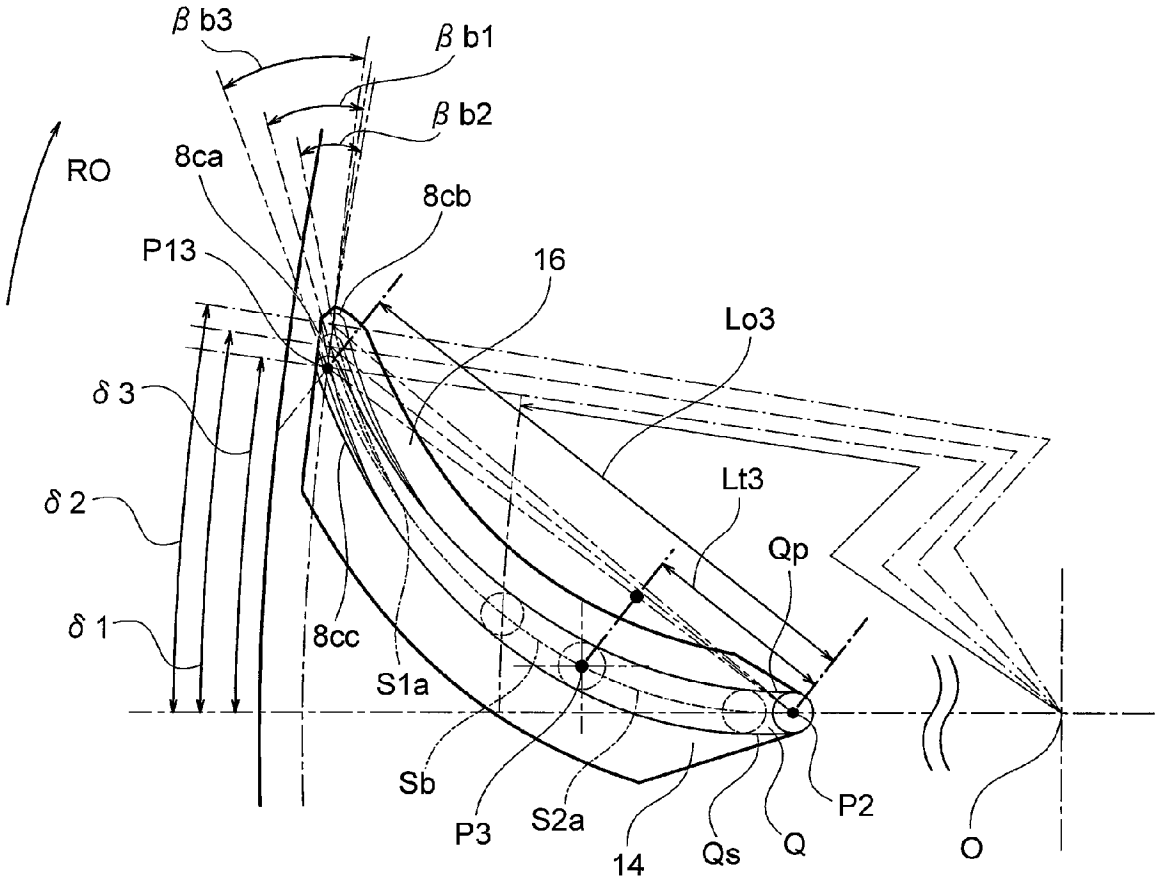
FIG. 10 is a sectional view of the blade of the cross-flow fan taken along the line B-B of FIG. 3.

In FIG. 3, a part illustrated on the left side of the drawing sheet is a front view of the impeller of the cross-flow fan of this embodiment, and a part illustrated on the right side of the drawing sheet is a side view of the impeller of the cross-flow fan. Further, FIG. 6 illustrates a side surface shape of the rib in a sectional view taken along the line A-A of FIG. 3. Further, FIGS. 7, 8, and 9 are sectional views taken along the line C-C, which is orthogonal to the rotational axis, of an inter-blade portion 8*cc* having a predetermined length WL3 of a distance WL between the two support plates (rings) 8*b* in FIG. 3 and formed between a blade ring vicinity portion 8*ca*, which has a predetermined length WL1 from the surface of each ring 8*b* inwardly of the impeller element 8*d*, and a blade ring center portion 8*cb*, which has a predetermined length WL2 at the longitudinal center between the two rings 8*b*. Note that, FIGS. 7, 8, and 9 are views illustrating a blade cross section as an example. Further, FIG. 10 is a view obtained by superimposing the cross section taken along the line A-A and the cross section taken along the line C-C onto the cross section taken along the line B-B of FIG. 3. The cross section taken along the line A-A (hereinafter referred to as "A-A cross section") is a cross section, which is orthogonal to the rotational axis, of the blade ring vicinity portion 8*ca* having the predetermined length WL1 from the surface of each ring 8*b* of FIG. 3 inwardly of the impeller element 8*c*. The cross section taken along the line B-B (hereinafter referred to as "B-B cross section") is a cross section, which is orthogonal to the rotational axis, of the blade ring center portion 8*cb* having the predetermined length WL2 at the longitudinal center between the two rings 8*b*. The cross section taken along the line C-C (hereinafter referred to as "C-C cross section") is a cross section, which is orthogonal to the rotational axis, of the inter-blade portion 8*cc* having the predetermined length WL3 and being formed between the blade ring vicinity portion 8*ca* and the blade ring center portion 8*cb*.

As illustrated in FIGS. 7, 8, and 9, an outer peripheral end portion (outer end portion) 15*a* and an inner peripheral end portion (inner end portion) 15*b* of the blade 8*c* are each formed into an arc shape. Further, the blade 8*c* is formed so that the outer peripheral end portion 15*a* side is inclined forward in the impeller rotational direction RO with respect to the inner peripheral end portion 15*b* side. That is, when the blade 8*c* is viewed in the vertical cross section, the blade pressure surface 13*a* and the blade suction surface 13*b* of the blade 8*c* are curved in the impeller rotational direction RO from the impeller rotation center O of the impeller 8*a* toward the outer side of the blade 8*c*.

A center of a circle corresponding to the arc shape formed in the outer peripheral end portion 15*a* is represented by P1 (hereinafter also referred to as "arc center P1"), and a center of a circle corresponding to the arc shape formed in the inner peripheral end portion 15*b* is represented by P2 (hereinafter also referred to as "arc center P2"). Further, when a line segment connecting together the arc centers P1 and P2 is represented by a blade chord line (blade chord) L, as illustrated in FIG. 8, the length of the blade chord line L is set to Lo (in FIG. 8, the length is also a blade chord length Lo3 of a third region) (hereinafter referred to as "blade chord length Lo").

The blade 8*c* includes the blade pressure surface 13*a*, which is a surface on the rotational direction RO side of the impeller 8*a*, and the blade suction surface 13*b*, which is a surface on an opposite side to the rotational direction RO side of the impeller 8*a*. In the vicinity of the center of the blade chord line L, the blade 8*c* has a recessed shape curved in a direction from the blade pressure surface 13*a* toward the blade suction surface 13*b*.

Further, in the blade 8*c*, a radius of a circle corresponding to the arc shape on the blade pressure surface 13*a* side is different between the outer peripheral side of the impeller 8*a* and the inner peripheral side of the impeller 8*a*. That is, as illustrated in FIG. 7, the surface of the blade 8*c* on the blade pressure surface 13*a* side is a multiple-arc curved surface and includes an outer peripheral curved surface Bp1 in which a radius (arc radius) corresponding to the arc shape on the outer peripheral side of the impeller 8*a* is Rp1, and an inner peripheral curved surface Bp2 in which a radius (arc radius) corresponding to the arc shape on the inner peripheral side of the impeller 8*a* is Rp2. Further, the surface of the blade 8*c* on the blade pressure surface 13*a* side includes a flat surface Qp having a planar shape, which is connected to an inner peripheral end portion of the end portions of the inner peripheral curved surface Bp2.

As described above, the surface of the blade 8*c* on the blade pressure surface 13*a* side is formed in a manner that the outer peripheral curved surface Bp1, the inner peripheral curved surface Bp2, and the flat surface Qp are continuously connected to one another. Note that, when the blade 8*c* is viewed in the vertical cross, section, the straight line forming the flat surface Qp is a tangent at a point connected to the arc forming the inner peripheral curved surface Bp2.

On the other hand, the surface of the blade 8*c* on the blade suction surface 13*b* side is a surface corresponding to the surface on the blade pressure surface 13*a* side. Specifically, the surface of the blade 8*c* on the blade suction surface 13*b* side includes an outer peripheral curved surface Bs1 in which a radius (arc radius) corresponding to the arc shape on the outer peripheral side of the impeller 8*a* is Rs1, and an inner peripheral curved surface Bs2 in which a radius (arc radius) corresponding to the arc shape on the inner peripheral side of the impeller 8*a* is Rs2. Further, the surface of the blade 8*c* on the blade suction surface 13*b* side includes a flat surface Qs with a planar shape, which is connected to an inner peripheral end portion of the end portions of the inner peripheral curved surface Bs2.

As described above, the surface of the blade 8*c* on the blade suction surface 13*b* side is formed in a manner that the outer peripheral curved surface Bs1, the inner peripheral curved surface Bs2, and the flat surface Qs are continuously connected to one another. Note that, when the blade 8*c* is viewed in the vertical cross section, the straight line forming the flat surface Qs is a tangent at a point connected to the arc forming the inner peripheral curved surface Bs2.

Next, the blade thickness is described. When the blade 8*c* is viewed in the vertical cross section, and when a diameter of a circle inscribed in the blade surfaces is represented by a blade thickness (thickness) t, as illustrated in FIG. 7, a blade thickness (thickness) t1 at the outer peripheral end portion 15*a* is smaller than a blade thickness (thickness) t2 at the inner peripheral end portion 15*b*. Note that, the blade thickness t1 corresponds to 2×radius R1 of the circle forming the arc of the outer peripheral end portion 15*a*, and the blade thickness t2 corresponds to 2×radius R2 of the circle forming the arc of the inner peripheral end portion 15*b*.

In other words, when the diameter of the circle inscribed in the blade pressure surface 13*a* and the blade suction surface 13*b* of the blade 8*c* represents the blade thickness, the blade thickness is formed as follows. The blade thickness of the outer peripheral end portion 15*a* is smaller than that of the inner peripheral end portion 15*b*, and the blade thickness gradually increases from the outer peripheral end portion 15*a* toward the center to become maximum at a predetermined position in the vicinity of the center. Then, the blade thickness gradually decreases toward the inner side to become substantially the same thickness at a straight portion Q.

Specifically, in a range of the outer peripheral curved surface Bp1, the inner peripheral curved surface Bp2, the outer peripheral curved surface Bs1, and the inner peripheral curved surface Bs2 formed in the blade pressure surface 13*a* and the blade suction surface 13*b* excluding the outer peripheral end portion 15*a* and the inner peripheral end portion 15*b*, the blade thickness t of the blade 8*c* gradually increases from the outer peripheral end portion 15*a* toward the center of the blade 8*c*, becomes a maximum thickness t3 at the predetermined position in the vicinity of the center of the blade chord line L, and gradually decreases toward the inner peripheral end portion 15*b*. Then, in a range of the straight portion Q, that is, in a range between the flat surface Qp and the flat surface Qs, the blade thickness t is the inner peripheral end portion thickness t2 that is a substantially constant value.

In this case, a part of the blade 8*c* having the flat surfaces Qp and Qs of the inner peripheral end portion 15*b* as surfaces is referred to as the straight portion Q. That is, the blade suction surface 13*b* of the blade 8*c* is formed of the multiple arcs and the straight portion Q from the outer peripheral side toward the inner peripheral side of the impeller.

In FIG. 10 in which the A-A cross section, the B-B cross section, and the C-C cross section of FIG. 3 are superimposed on one another, the radius R1 of a straight line O-P1 connecting together the impeller rotation center O and the arc center P1 of the arc-shaped blade outer peripheral end portion 15*a* of the blade 8*c* is the same dimension in the impeller rotational axis direction for all of the blade ring vicinity portion 8*ca*, the blade ring center portion 8*cb*, and the inter-blade portion 8*cc*, and an impeller effective outer radius corresponding to a diameter of a circumscribed circle of the entire blade is the same in the longitudinal direction.

A thickness center line between the surface 13*a* of the blade 8*c* on the rotational direction RO side (pressure surface) and the surface 13*b* of the blade 8*c* on the opposite side to the rotational direction RO side (suction surface) is represented by a camber line Sb. A part of the camber line Sb on the outer peripheral side with respect to a position of a predetermined radius R03 from the impeller rotation center O is represented by an outer peripheral camber line S1*a*, and a part of the camber line Sb on the inner peripheral side with respect to the position of the predetermined radius R03 from the impeller rotation center O is represented by an inner peripheral camber line S2*a*. Note that, the above-mentioned position of the predetermined radius R03 (not shown) is a position at which the blade outlet angle changes. Then, when a narrow angle formed between a tangent of a circle having the impeller rotation center O as a center and passing through the arc center P1 of the blade outer peripheral end portion 15*a* of the blade 8*c*, and the tangent of the blade outer peripheral camber line S1*a* at the arc center P1 is represented by a blade outlet angle βb, the blade outlet angle differs among a first region (blade ring vicinity portion 8*ca*), a second region (blade ring center portion 8*cb*), and a third region (inter-blade portion 8*cc* between the blade ring vicinity portion 8*ca* and the blade ring center portion 8*cb*). The outer peripheral side of the blade ring center portion 8*cb* is shaped so as to most advance in the impeller rotational direction RO as compared to the other regions, and the outer peripheral side of the inter-blade portion 8*cc* is shaped so as to most retreat in contrast. Further, a coupling portion 8*ce* is formed as an inclined surface in which a blade sectional shape of an adjacent region gradually changes. In other words, the blade 8*c* is formed of five regions and four coupling portions 8*ce* in the order of the ring 8*b* on one side, the blade ring vicinity portion 8*ca*, the coupling portion 8*ce*, the inter-blade portion 8*cc*, the coupling portion 8*ce*, the blade ring center portion 8*cb*, the coupling portion 8*ce*, the inter-blade portion 8*cc*, the coupling portion 8*ce*, the blade ring vicinity portion 8*ca*, and the ring 8*b* on the other side. Further, the blade ring vicinity portion 8*ca*, the blade ring center portion 8*cb*, the inter-blade portion 8*cc*, and the coupling portion 8*ce* are each formed into the same shape in the longitudinal direction in each of the widths of the predetermined lengths WL1, WL2, WL3, and WL4.

Further, in FIG. 10, when the blade outlet angles of the respective regions are represented by a first-region (blade ring vicinity portion 8*ca*) blade outlet angle βb1, a second-region (blade ring center portion 8*cb*) blade outlet angle βb2, and a third-region (inter-blade portion 8*cc* between the blade ring vicinity portion 8*ca* and the blade ring center portion 8*cb*) blade outlet angle βb3, the blade is formed so as to satisfy ρb2<βb1<βb3. Therefore, as illustrated in FIGS. 4 and 5, the blade outer peripheral end portion 15*a* has a blade sectional shape that is most retreated in a direction opposite to the rotational direction in the third region, and has a blade sectional shape that is most advanced in the rotational direction in the second region. In other words, the blade has a plurality of regions each having a blade cross section orthogonal to the impeller rotational axis, which differs among the regions of the blade adjacent to one another in the impeller rotational axis direction. Note that, reference symbol δ in FIG. 10 represents a blade advancing angle. Specifically, reference symbol δ1 represents a blade advancing angle of the first region, reference symbol δ2 represents a blade advancing angle of the second region, and reference symbol δ3 represents a blade advancing angle of the third region. Further, reference symbol P13 in FIG. 10 represents an arc center of the blade leading edge in the third region.

Figure 11:
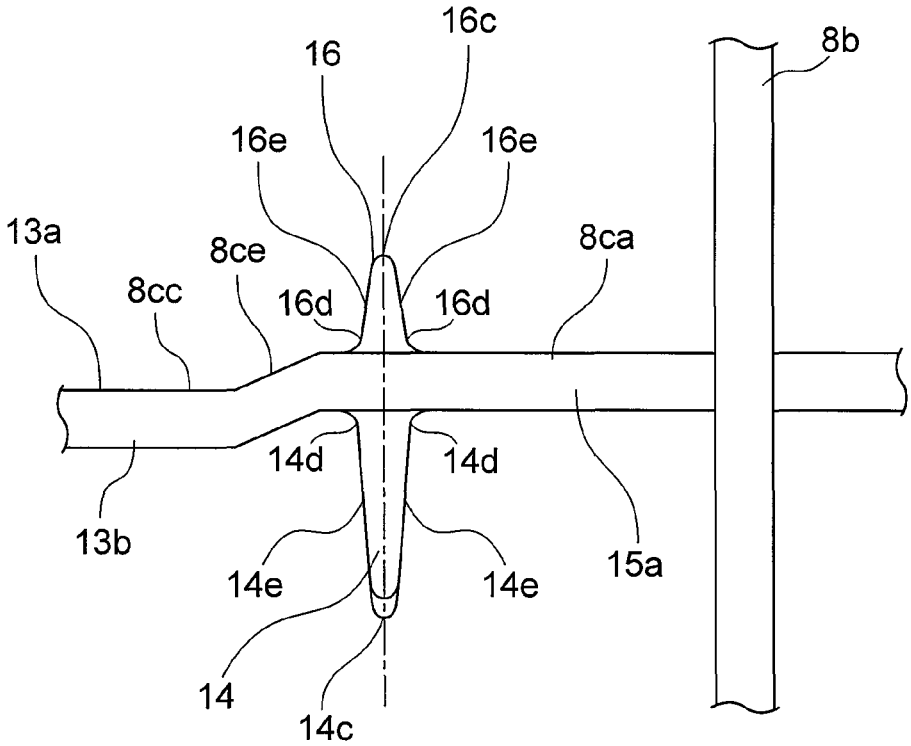
FIG. 11 is a schematic view of a case where ribs are formed on a blade ring vicinity portion in the vicinity of a coupling portion, which is viewed from the arrow Va of FIG. 6.
Figure 12:
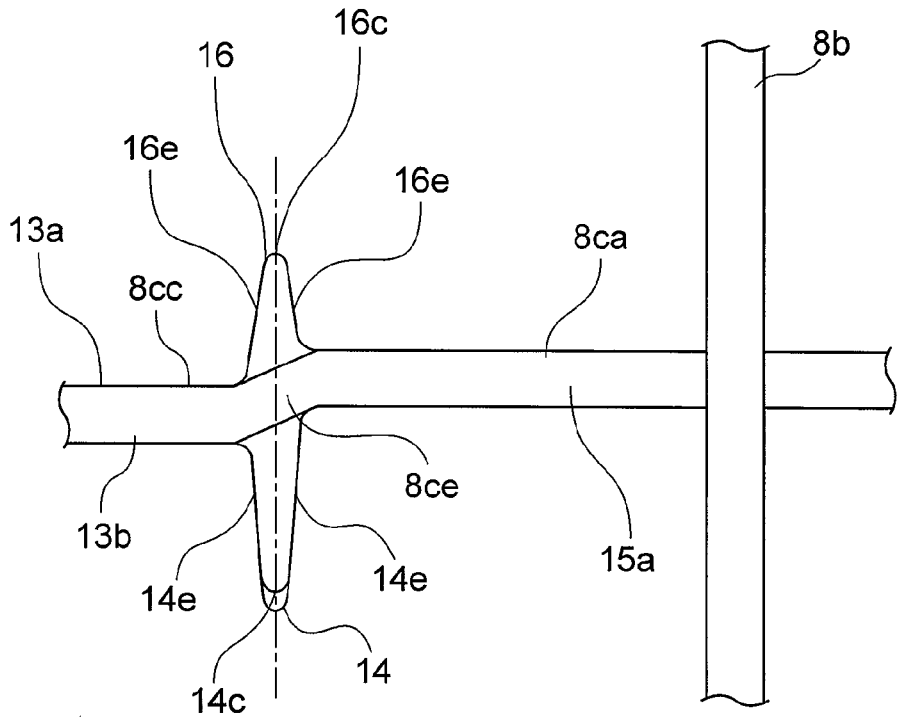
FIG. 12 is a schematic view of a case where the ribs are formed on the coupling portion, which is viewed from the arrow Va of FIG. 6.
Figure 13:
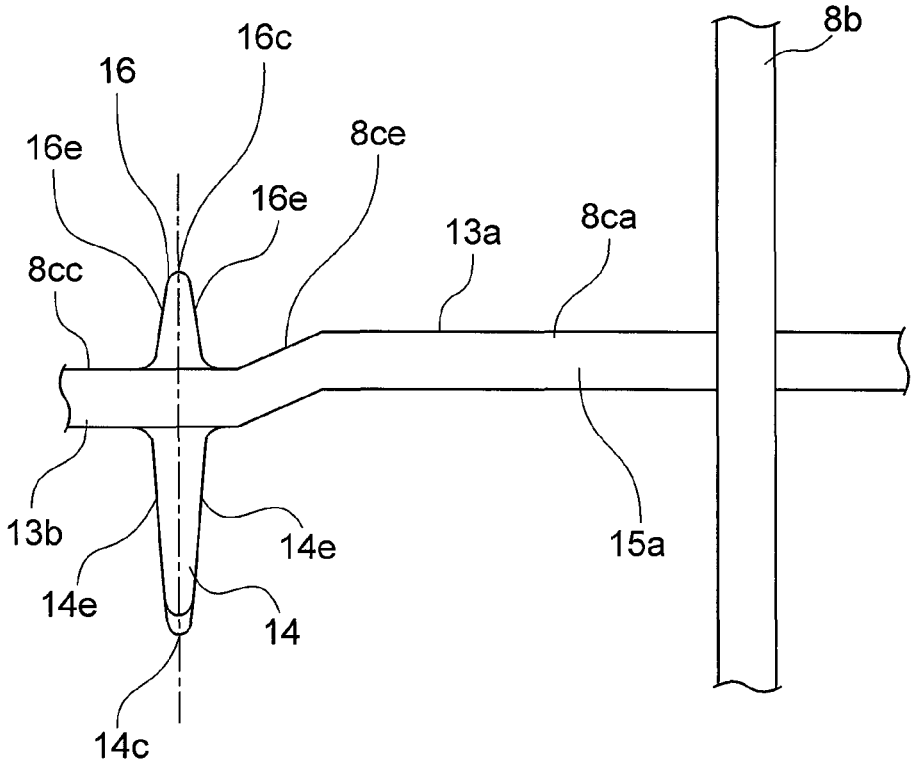
FIG. 13 is a schematic view of a case where ribs are formed on an inter-blade portion in the vicinity of the coupling portion, which is viewed from the arrow Va of FIG. 6.
Figure 14:
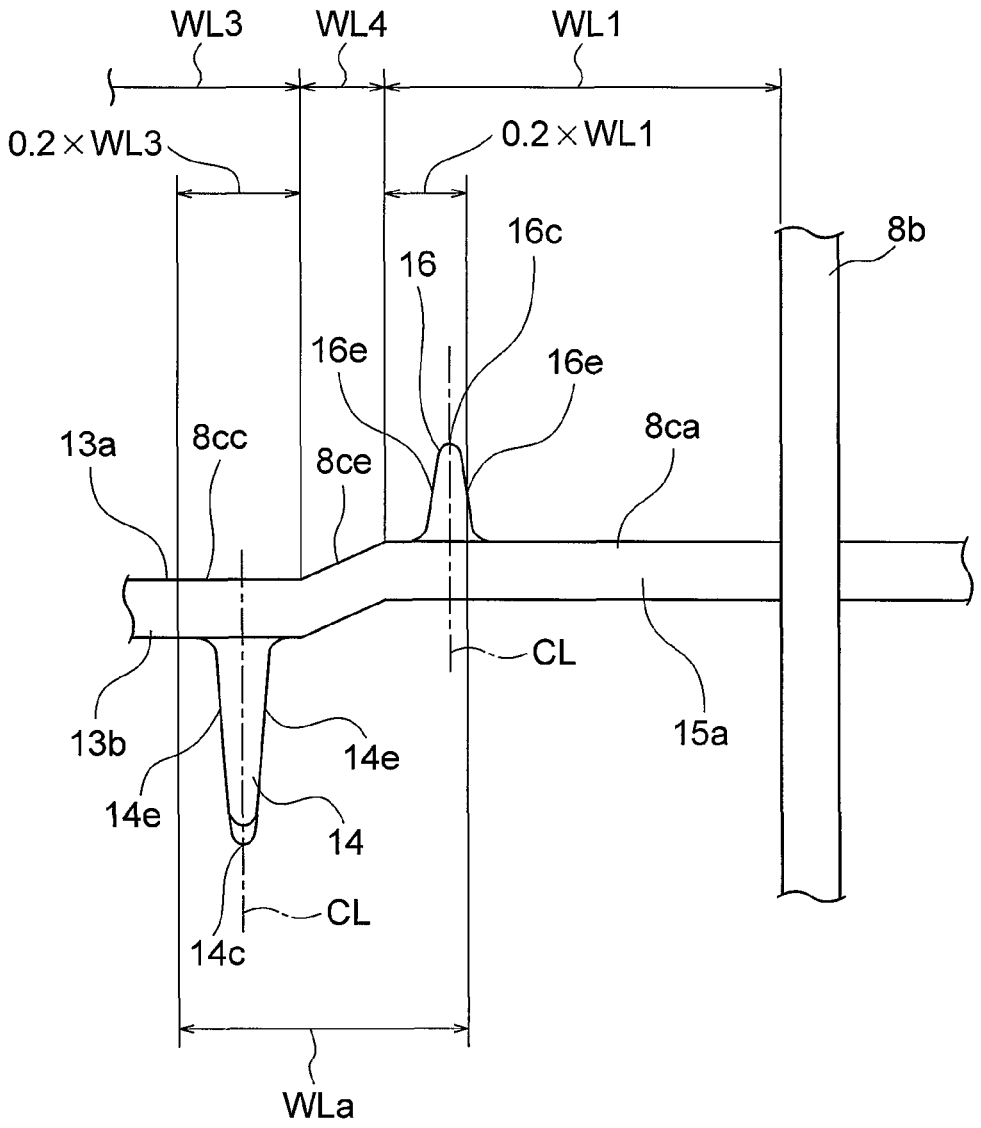
FIG. 14 is a schematic view of a case where the ribs are formed at positions different in an impeller rotational axis direction in the vicinity of the coupling portion, which is viewed from the arrow Va of FIG. 6.

Further, as illustrated in FIGS. 4 and 5, ribs 14 and 16, which are each erected at a predetermined height toward the adjacent blade, are each formed so as to be substantially orthogonal to the impeller rotational axis and on the blade ring vicinity portion 8*ca* in the vicinity of the coupling portion 8*ce* between the blade ring vicinity portion 8*ca*, which is a portion in the vicinity of the ring 8*b*, and the inter-blade portion 8*cc* adjacent thereto in the impeller rotational axis direction in each of the blade pressure surface 13*a* and the blade suction surface 13*b* of the blade. The ribs 14 and 16 are each formed on the coupling portion 8*ce* or in one of a pair of regions adjacent to the coupling portion 8*ce* on both sides of the coupling portion 8*ce* within a range separated away from the coupling portion 8*ce* by up to 20% of the length of the region adjacent to the coupling portion 8*ce* in the rotational axis direction. That is, as described with reference to the example of FIG. 14 described later, the ribs 14 and 16 are each formed so that the thickness center line CL of each of the ribs 14 and 16 falls within a rib installing region that is a range represented by a length WLa in the rotational axis direction. The length WLa in the rib installing region is a length obtained by adding the length WL4 of the coupling portion 8*ce* itself, 0.2×WL1, which is 20% of the length WL1 of the blade ring vicinity portion 8*ca* adjacent to the coupling portion 8*ce*, and 0.2×WL3, which is 20% of the length WL3 of the inter-blade portion 8*cc* adjacent to the coupling portion 8*ce*. Note that, the range represented by 0.2×WL1 here is not simply the length at an arbitrary position on the blade ring vicinity portion 8*ca*. One end of the range represented by 0.2×WL1 is positioned at a boundary between the blade ring vicinity portion 8*ca* and the coupling portion 8*ce*, and the other end of the range represented by 0.2×WL1 is positioned on the blade ring vicinity portion 8*ca* so as to be separated by 0.2×WL1 from the boundary between the blade ring vicinity portion 8*ca* and the coupling portion 8*ce*. Similarly, one end of the range represented by 0.2×WL3 is positioned at the boundary between the inter-blade portion 8*cc* and the coupling portion 8*ce*, and the other end of the range represented by 0.2×WL3 is positioned on the inter-blade portion 8*cc* so as to be separated by 0.2×WL3 from the boundary between the inter-blade portion 8*cc* and the coupling portion 8*ce*. In all FIGS. 11 to 14 to be described later, the ribs 14 and 16 are each positioned in the rib installing region represented by the length WLa. In particular, FIG. 11 is an example of a case where both of the front and back ribs are positioned in the range represented by 0.2×WL1, FIG. 12 is an example of a case where both of the front and back ribs are positioned in the range represented by WL4, and FIG. 13 is an example of a case where both of the front and back ribs are positioned in the range represented by 0.2×WL3. Further, FIG. 14 is an example of a case where one of the front and back ribs is positioned in the range represented by 0.2×WL1, and the other of the front and back ribs is positioned in the range represented by 0.2×WL3.

As illustrated in FIG. 6, the rib 14 is formed in a region between an outer diameter Rt1 of the blade outer peripheral end portion 15*a* and an inner diameter Rt2 of the blade inner peripheral end portion 15*b* (annular virtual region on the outer side of a virtual circle having the inner diameter Rt2 of the blade and on the inner side of a virtual circle having the outer diameter Rt1 of the blade). Further, a rib outer peripheral end portion 14*a* of the rib 14 on the blade suction surface 13*b* side is formed flush with the outer diameter Rt1 of the blade outer peripheral end portion 15*a*, and a rib inner peripheral end portion 14*b* of the rib 14 is formed into a shape inclined on the blade chord inner side (side approaching the blade chord) with respect to a straight line orthogonal to the blade chord L at the inner peripheral end portion 15*b*. The leading end in the erected direction of each of the rib outer peripheral end portion 14*a* and the rib inner peripheral end portion 14*b* is formed into an arc shape.

Further, a rib upper end portion 14*c* is formed as a curved surface obtained by moving a curved surface of the blade suction surface 13*b* by a predetermined distance in the direction orthogonal to the blade chord L. The leading end in the erected direction of the rib upper end portion 14*c* is formed into an arc shape.

Further, as illustrated in FIG. 11, from a root 14*d* of the rib toward the rib upper end portion 14*c*, the thickness is gradually thinned to form a tapered shape from the blade suction surface 13*b* so as to be equal to or more than the thickness t1 of the blade outer peripheral end portion 15*a*, which is the minimum thickness of the blade, and equal to or less than the thickness t3 in the vicinity of the center of the blade chord, which is the maximum thickness of the blade. That is, side surfaces 14*e* on both sides of the rib 14 are inclined so that an interval therebetween is narrowed from the root 14*d* toward the leading end in the erected direction.

Further, as illustrated in FIG. 6, the rib 16 on the blade pressure surface 13*a* side is formed in the region between an outer diameter Rt1 of the blade outer peripheral end portion 15*a* and an inner diameter Rt2 of the blade inner peripheral end portion 15*b*. Further, a rib outer peripheral end portion 16*a* of the rib 16 on the blade pressure surface 13*a* side is formed flush with the outer diameter Rt1 of the blade outer peripheral end portion 15*a*, and a rib inner peripheral end portion 16*b* thereof is formed into a shape inclined on the blade chord inner side with respect to a straight line orthogonal to the blade chord L. The leading end in the erected direction of each of the rib outer peripheral end portion 16*a* and the rib inner peripheral end portion 16*b* is formed into an arc shape.

Further, a rib upper end portion 16*c* is formed as a curved surface obtained by moving a curved surface of the blade suction surface 13*b* by a predetermined distance in the direction orthogonal to the blade chord L. The leading end in the erected direction of the rib upper end portion 16*c* is formed into an arc shape.

Further, as illustrated in FIG. 11, from a root 16*d* of the rib toward the rib upper end portion 16*c*, the thickness is gradually thinned to form a tapered shape from the blade pressure surface 13*a* so as to be equal to or more than the thickness t1 of the blade outer peripheral end portion 15*a*, which is the minimum thickness of the blade, and equal to or less than the thickness t3 in the vicinity of the center of the blade chord, which is the maximum thickness of the blade. That is, side surfaces 16*e* on both sides of the rib 16 are inclined so that an interval therebetween is narrowed from the root 16*d* toward the leading end in the erected direction.

Further, the height of the rib 14 on the blade suction surface side and the height of the rib 16 on the blade pressure surface side are formed as follows. Assuming that both of the ribs are installed, as illustrated in FIGS. 11 to 14, the ribs are formed to be equal to or less than half of the blade pitch so as to prevent the rib from colliding with the adjacent blade. Further, the ribs are formed so as to satisfy (height of rib 16 on blade pressure surface side)<(height of rib 14 on blade suction surface side).

Figure 15:
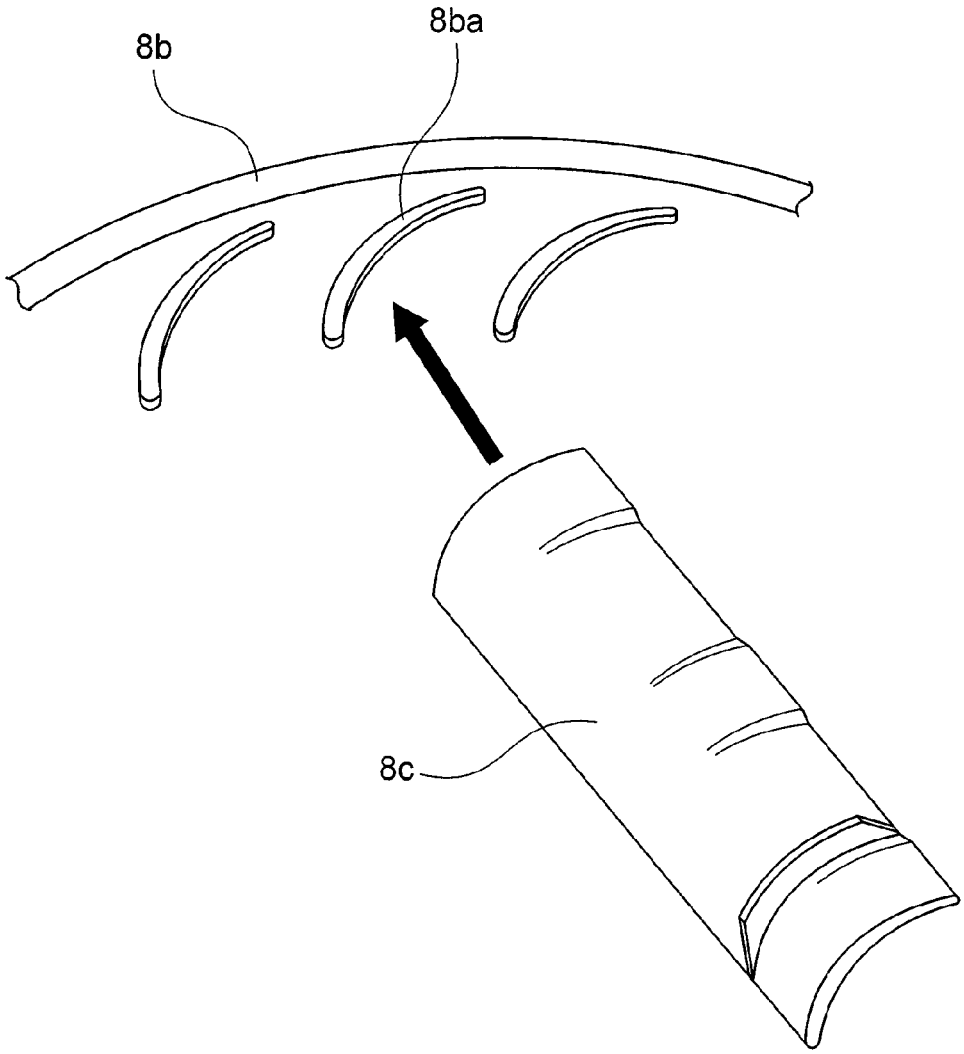
FIG. 15 is a schematic view illustrating the mounting of the blade to a support plate.

Further, the impeller 8*a* is formed as follows. As illustrated in FIG. 15, the plurality of blades 8*c* each having the rib erected on the blade surface thereof according to present invention and the rings 8*b* each having a plurality of grooves 8*ba* formed in both surfaces thereof, through which the blades 8*c* are inserted, are individually molded. Next, the blades 8*c* are inserted into the grooves 8*ba* formed in one surface of the ring 8*b* so that the directions of the blade pressure surfaces 13*a* and the blade suction surfaces 13*b* of the blades 8*c* are finally aligned. Then, the blades 8*c* and the ring 8*b* are welded and fixed. This operation is carried out once or a plurality of times, to thereby form the impeller element 8*d*. After that, the blades 8*c* fixed to the impeller element 8*d* are inserted into the grooves 8*ba* formed in the other surface of the ring 8*b*, and the blades 8*c* and the ring 8*b* are welded and fixed. This operation is carried out a plurality of times to couple a plurality of the impeller elements 8*d* to each other, thereby forming the impeller 8*a*.

The cross-flow fan having the above-mentioned configuration and the air conditioner having the cross-flow fan mounted thereon may obtain the following effects.

<First Characteristic Effect>

"Effect of Basic Blade Sectional Shape"

A part of the blade 8*c* having the flat surfaces Qp and Qs of the inner peripheral end portion 15*b* as surfaces is referred to as the straight portion Q. The blade suction surface 13*b* of the blade 8*c* is formed of multiple arcs and the straight portion Q from the outer peripheral side toward the inner peripheral side of the impeller.

(1) When the blade 8*c* passes through the inlet-side air duct E1, the flow on the blade surface that is about to separate at the outer peripheral curved surface Bs1 reattaches onto the next inner peripheral curved surface Bs2 having a different arc radius.

(2) Further, the blade 8*c* has the flat surface Qs to generate a negative pressure. Therefore, the flow reattaches even when the flow is about to separate at the inner peripheral curved surface Bs2.

(3) Further, the blade thickness t is larger on the impeller inner peripheral side than on the impeller outer peripheral side, and hence the distance between the adjacent blades 8*c* is reduced.

(4) Further, the flat surface Qs is flat. Therefore, unlike the case of a curved surface, the blade thickness t does not abruptly increase toward the impeller outer periphery, and hence the frictional resistance can be suppressed.

The blade pressure surface 13*a* of the blade 8*c* is also formed of multiple arcs and the straight portion (flat surface) from the outer peripheral side toward the inner peripheral side of the impeller.

(5) When air flows from the outer peripheral curved surface Bp1 toward the inner peripheral curved surface Bp2 having a different arc radius, the flow gradually accelerates to generate a pressure gradient on the blade suction surface 13*b*. Therefore, the separation is suppressed and no abnormal fluid noise is generated.

(6) Further, the flat surface Qp on the downstream side is a tangent to the inner peripheral curved surface Bs2. In other words, the blade 8*c* has the flat surface Qp on the downstream side, and hence the blade 8*c* is shaped so as to be bent at a predetermined angle with respect to the rotational direction RO. Therefore, unlike the case where the straight surface (flat surface Qp) is absent, the flow can be directed toward the blade suction surface 13*b* even when the blade thickness t2 of the inner peripheral end portion 15*b* is large. Thus, the wake vortex can be suppressed when air flows into the impeller from the inner peripheral end portion 15*b*.

(7) The blade 8*c* has the thick inner peripheral end portion 15*b*. Thus, separation is less liable to occur in various inflow directions in the outlet-side air duct E2.

(8) Further, the blade 8*c* has the maximum thickness in the vicinity of the center of the blade chord, which is positioned on the downstream side of the flat surface Qs. Therefore, when the flow is about to separate after passing along the flat surface Qs, the air flows along the inner peripheral curved surface Bs2 because the blade thickness t is gradually increased toward the vicinity of the center of the blade chord, which suppresses the separation.

(9) Further, the blade 8*c* has the inner peripheral curved surface Bs1 having a different arc radius on the downstream side of the inner peripheral curved surface Bs2. Therefore, the separation of the flow is suppressed, the effective outlet-side air duct from the impeller can be increased, the outlet airflow velocity is reduced and equalized, and the load torque applied to the blade surface can be reduced. As a result, the separation of the flow from the blade surface can be suppressed on the inlet side and the outlet side of the impeller. Therefore, the noise can be reduced, and further the power consumption of the fan motor can be reduced. In other words, an air conditioner 100 having a quiet and energy-saving cross-flow fan 8 mounted thereon can be obtained.

The blade 8*c* may be formed so as to satisfy the following magnitude relationship for the arc radii Rp1, Rp2, Rs1, and Rs2. That is, the blade 8*c* may be formed so as to satisfy Rs1>Rp1>Rs2>Rp2. In this case, in the outlet-side air duct E2, the blade 8*c* produces the following effects.

(10) In the blade suction surface 13*b*, the arc radius Rs1 of the outer peripheral curved surface Bs1 is larger than the arc radius Rs2 of the inner peripheral curved surface Bs2, and forms a relatively-flat arc having a small curvature level. Therefore, in the outlet-side air duct E2, the flow passes along the outer peripheral curved surface Bs1 to reach the vicinity of the outer peripheral end portion 15*a*, and thus the wake vortex can be reduced.

(11) In the blade pressure surface 13*a*, the arc radius Rp1 of the outer peripheral curved surface Bp1 is larger than the arc radius Rp2 of the inner peripheral curved surface Bp2, and forms a relatively-flat arc having a small curvature level. Therefore, the flow becomes smooth without concentrating on the blade pressure surface 13*a* side. Therefore, the frictional loss can be reduced.

On the other hand, in the inlet-side air duct E1, the blade 8*c* produces the following effects.

(12) The outer peripheral curved surface Bs1 forms a relatively-flat arc having a small curvature level. Therefore, the flow is not sharply turned. Therefore, the flow can pass along the blade suction surface 13*b* without separation.

(13) Then, as a result of Items (10) and (11), the separation of the flow from the blade surface can be suppressed on the inlet side and the outlet side of the impeller. Therefore, the noise can be reduced, and further the power consumption of the fan motor can be reduced. In other words, an air conditioner 100 having a quiet and energy-saving cross-flow fan 8 mounted thereon can be obtained.

"Effect Obtained by Setting Lp/Lo and Ls/Lo, which are Ratios of Blade Chord Maximum Camber Lengths Lp and Ls to Blade Chord Length Lo"

First, as illustrated in FIG. 8, a contact point between a line Wp, which is parallel to the blade chord line L and tangent to the blade pressure surface 13*a*, and the blade pressure surface 13*a* is represented by a maximum camber position Mp, and a contact point between a line Ws, which is parallel to the blade chord line L and tangent to the blade suction surface 13*b*, and the blade suction surface 13*b* is represented by a maximum camber position Ms. Further, an intersection with a line that is perpendicular to the blade chord line L and passes through the maximum camber position Mp is represented by a maximum camber blade chord point Pp, and an intersection with a line that is perpendicular to the blade chord line L and passes through the maximum camber position Ms is represented by a maximum camber blade chord point Ps. Further, a distance between the arc center P2 and the maximum camber blade chord point Pp is represented by a blade chord maximum camber length Lp, and a distance between the arc center P2 and the maximum camber blade chord point Ps is represented by a blade chord maximum camber length Ls. Further, a line segment distance between the maximum camber position Mp and the maximum camber blade chord point Pp is represented by a maximum camber height Hp, and a line segment distance between the maximum camber position Ms and the maximum camber blade chord point Ps is represented by a maximum camber height Hs. Then, the ratios Lp/Lo and Ls/Lo of the blade chord maximum camber lengths Lp and Ls to the blade chord length Lo are set as follows, to thereby reduce the noise.

Note that, when the maximum camber position is arranged excessively on the outer peripheral side, the inner peripheral curved surface Bs2 becomes excessively close to a plane. Further, when the maximum camber position is arranged excessively on the inner peripheral side, the outer peripheral curved surface Bs1 becomes excessively close to a plane, and the inner peripheral curved surface Bs2 is excessively warped. As described above, when a part excessively close to a plane and a part excessively warped are formed in the blade 8*c*, the separation is liable to occur in the outlet-side air duct E2, and the noise is deteriorated. In view of this, in this embodiment, the blade 8*c* is formed so as to have the maximum camber position in an optimum range.

First, the case where Ls/Lo and Lp/Lo are smaller than 40% and the maximum camber position is closer to the inner peripheral side of the impeller corresponds to a case where the arc radii of the inner peripheral curved surfaces Bs2 and Bp2 of the blade 8*c* are small. Then, the case where the arc radii of the inner peripheral curved surfaces Bs2 and Bp2 of the blade 8*c* are small corresponds to a case where the warpage is increased and thus the surface is curved sharply. Therefore, in the outlet-side air duct E2, the flow that has passed through the inner peripheral end portion 15*b* and along the flat surface Qs and the flat surface Qp cannot pass along the inner peripheral curved surfaces Bs2 and Bp2. Thus, the flow is separated to cause pressure fluctuation.

Further, the case where Ls/Lo and Lp/Lo are larger than 50% and the maximum camber position is closer to the outer peripheral side of the impeller corresponds to a case where the arc radii of the outer peripheral curved surfaces Bs1 and Bp1 of the blade 8*c* are large. Then, the case where the arc radii of the outer peripheral curved surfaces Bs1 and Bp1 of the blade 8*c* are large corresponds to a case where the warpage of the blade 8*c* is small. Therefore, the flow is separated from the outer peripheral curved surfaces Bs1 and Bp1 of the blade 8*c*, and the wake vortex is increased.

Further, even if Lp/Lo and Ls/Lo are within the range of from 40% to 50%, when Ls/Lo>Lp/Lo is satisfied, the maximum camber position of the blade suction surface 13*b* is arranged on the outer peripheral side with respect to the maximum camber position of the blade pressure surface 13*a*. Therefore, the interval between the adjacent blades 8*c* varies to increase and decrease from the inner peripheral end portion 15*b* toward the outer peripheral end portion 15*a*, which causes the pressure fluctuation.

(14) In view of this, in this embodiment, the blade 8*c* is formed so as to satisfy 40%≤Ls/Lo<Lp/Lo≤50%. Thus, the separation of the flow from the blade surface can be suppressed on the inlet side and the outlet side of the impeller. Therefore, the noise can be reduced, and further the power consumption of the fan motor can be reduced. In other words, an air conditioner 100 having a quiet and energy-saving cross-flow fan 8 mounted thereon can be obtained.

"Effect Obtained by Setting Maximum Camber Heights"

When the maximum camber heights Hp and Hs are too large, the arc radius of the curved surface may be too small, and the warpage may be too large. When the maximum camber heights Hp and Hs are too small, the arc radius of the curved surface may be too large, and the warpage may be too small. Further, the flow may be uncontrollable because the interval between the adjacent blades 8*c* is too wide. Thus, a separation vortex may be generated on the blade surface to cause an abnormal fluid noise. In contrast, the interval may be too narrow, which increases the airflow rate and noise. In view of this, in this embodiment, the blade 8*c* is formed so as to have the maximum camber heights in an optimum range.

Reference symbols Hp and Hs respectively represent the maximum camber height of the blade pressure surface 13*a* and the maximum camber height of the blade suction surface 13*b*, and hence a relationship of Hs>Hp is satisfied. When Hs/Lo and Hp/Lo are smaller than 10%, the flow may be uncontrollable because the arc radius of the curved surface is too large, the warpage is too small, and the interval between the adjacent blades 8*c* is too wide. Thus, the separation vortex may be generated on the blade surface, and an abnormal fluid noise may be generated. In the end, the noise level may be abruptly deteriorated. In contrast, when Hs/Lo and Hp/Lo are larger than 25%, because the interval between the adjacent blades is too narrow, the airflow rate may increase, and the noise may be abruptly deteriorated.

(15) In view of this, in this embodiment, the blade 8*c* is formed so as to satisfy 25%≥Hs/Lo>Hp/Lo≥10%. Thus, the separation of the flow from the blade surface can be suppressed on the inlet side and the outlet side of the impeller. Therefore, the noise can be reduced, and further the power consumption of the fan motor can be reduced. In other words, an air conditioner 100 having a quiet and energy-saving cross-flow fan 8 mounted thereon can be obtained.

"Effect Obtained by Relationship Between Blade Chord Length Lf of Straight Portion Q and Blade Chord Length Lo"

A center of an inscribed circle illustrated so as to contact with a connection position between the inner peripheral curved surface Bp2 and the flat surface Qp (first connection position) and a connection position between the inner peripheral curved surface Bs2 and the flat surface Qs (second connection position) is represented by P4 (see FIG. 9). In a part of the blade 8*c* on the outer peripheral side with respect to the straight portion Q, a center line of the blade 8*c* passing between the inner peripheral curved surface Bp2 and the inner peripheral curved surface Bs2 is represented by a thickness center line Sb. Further, a straight line passing through the center P4 and the arc center P2 is represented by an extended line Sf. A tangent of the thickness center line Sb at the center P4 is represented by Sb1. An angle formed between the tangent Sb1 and the extended line Sf is represented by a bent angle θe. Further, a distance between a line that is perpendicular to the blade chord line L and passes through the arc center P2 and a line that is perpendicular to the blade chord line L and passes through the center P4 is represented by a straight portion blade chord length Lf. A center of an inscribed circle in the maximum thickness portion of the blade is represented by P3. An intersection between the blade chord line and a line that is perpendicular to the blade chord line and passes through the center P3 is represented by Pt. A distance between the line that is perpendicular to the blade chord line L and passes through the center P3 and the line that is perpendicular to the blade chord line L and passes through the arc center P2 is represented by a maximum thickness portion length Lt (FIG. 9 illustrates a blade chord length Lt3 of the third region).

When the blade chord length Lf of the straight portion Q of the inner peripheral end portion 15*b* of the blade 8*c* is too large with respect to the blade chord length Lo, as a result, the arc radii of the outer peripheral curved surfaces Bp1 and Bs1 and the inner peripheral curved surfaces Bp2 and Bs2 on the outer peripheral side with respect to the straight portion Q decrease, and the warpage increases. Therefore, the flow tends to separate, which increases the loss and fan motor input. In addition, the distance between the blades 8*c* significantly changes from the inner peripheral side to the outer peripheral side to cause the pressure fluctuation, and hence the noise increases.

In contrast, when the blade chord length Lf of the straight portion Q is too small with respect to the blade chord length Lo, and the inner peripheral side of the blade is almost entirely a curved surface, after the flow collides with the inner peripheral end portion 15*b*, the flow separates without reattaching because a negative pressure is not generated on the blade suction surface 13*b*. Thus, there arises a problem in that the noise is increased. In particular, when dust is accumulated on the filter 5 to increase the ventilation resistance, such a problem remarkably arises.

Regarding this point, based on the reviews of the inventors of the present invention, when Lf/Lo is 30% or less, the increase in fan motor input can be suppressed. Further, when Lf/Lo is 5% or more and 30% or less, the increase in noise can also be suppressed.

(16) In view of this, in this embodiment, the blade 8*c* is formed so as to satisfy 30%≥Lf/Lo≥5%. Thus, the separation of the flow from the blade surface can be suppressed on the inlet side and the outlet side of the impeller. Therefore, the noise can be reduced, and further the power consumption of the fan motor can be reduced. In other words, an air conditioner 100 having a quiet and energy-saving cross-flow fan 8 mounted thereon can be obtained.

"Effect Obtained by Setting Bent Angle θe"

When the straight portion Q formed of the flat surfaces Qs and Qp, which are surfaces of the straight portion Q formed on the impeller inner peripheral side of the blade 8*c*, is formed tangent to the multiple-arc shaped portion on the impeller outer peripheral side or bent in the impeller rotational direction to direct the flow toward the blade suction surface 13*b* as compared to the case where the straight surface is absent, even if the blade thickness t2 of the inner peripheral end portion 15*b* is large, the wake vortex can be suppressed when the air flows into the impeller from the inner peripheral end portion 15*b*. However, when the bent angle is too large, in contrast, the wake vortex width may be enlarged, or large separation may be caused at the inner peripheral end portion 15*b* in the outlet-side air duct E2. Thus, the efficiency may be deteriorated, and the fan motor input may be increased.

When the bent angle 9*e* is negative, that is, when the blade 8*c* is bent in a counter-rotational direction, in the outlet-side air duct E2, the flow collides with the flat surface Qp on the pressure surface side, and separates from the flat surface Qs on the suction surface side. Thus, the flow stalls. Further, when the bent angle θe is larger than 15°, in the inlet-side air duct E1, the flow is sharply bent on the flat surface Qp that is a surface of the straight portion Q on the pressure surface side, and the flow is concentrated to increase the airflow velocity. Further, the flow separates from the flat surface Qs that is a surface of the straight portion Q on the suction surface side. Thus, the wake vortex is released in a significantly enlarged range, and the loss increases.

(17) In view of this, in this embodiment, the blade 8*c* is formed so as to satisfy 0°≤θe≤15°. In this manner, the separation of the flow from the blade surface can be suppressed on the inlet side and the outlet side of the impeller. Therefore, the noise can be reduced, and further the power consumption of the fan motor can be reduced. In other words, an air conditioner 100 having a quiet and energy-saving cross-flow fan 8 mounted thereon can be obtained.

"Effect Obtained by Setting Lt/Lo"

When the maximum thickness portion of the blade 8*c* is positioned on the impeller outer peripheral side with respect to the midpoint of the blade chord line L (in other words, when Lt/Lo is larger than 50%), an inter-blade distance is narrowed, which is represented by a diameter of an inscribed circle illustrated in contact with a suction surface of a blade 8*c* and a pressure surface of a blade 8*c* adjacent to this blade 8*c*. With this, the passing airflow velocity is increased, the ventilation resistance is increased, and the fan motor input is increased.

Further, when the maximum thickness portion is positioned closer to the inner peripheral end portion 15*b*, in the outlet-side air duct E2, after the flow collides with the inner peripheral end portion 15*b*, the flow separates without reattaching up to the outer peripheral curved surfaces Bp1 and Bs1 on the downstream side. With this, the passing airflow velocity is increased, the loss is increased, and the fan motor input is increased.

(18) In view of this, in this embodiment, the blade 8*c* is formed so as to satisfy 40%≤Lt/Lo≤50%. Thus, the separation of the flow from the blade surface can be suppressed on the inlet side and the outlet side of the impeller. Therefore, the noise can be reduced, and further the power consumption of the fan motor can be reduced. In other words, an air conditioner 100 having a quiet and energy-saving cross-flow fan 8 mounted thereon can be obtained.

"Effect of Three-Dimensional Blade (Shape in which Blade Cross Section Differs in Rotational Axis Direction)"

(19) In the longitudinal direction that is the impeller rotational axis direction of the cross-flow fan, the outer diameter of the outer peripheral end portion of the blade in the blade sectional view orthogonal to the impeller rotational axis is substantially the same. Therefore, as compared to the blade shape in which the outer diameter differs in the impeller rotational axis direction as in the related art, the leakage flow at the stabilizer for separating the inlet region and the outlet region of the impeller can be suppressed, and the efficiency can be increased.

(20) Further, when the blade is divided into a plurality of regions in the longitudinal direction between the pair of support plates so that both the end regions adjacent to the support plates under a state in which the impeller is formed are the first regions, the blade ring center portion is the second region, and the regions arranged on both sides of the blade ring center portion between the first region and the second region are the third regions, the respective regions are shaped to have different blade outlet angles to set appropriate blade outlet angles. Thus, the separation of the flow can be suppressed, and the noise can be reduced. In this manner, as compared to the case where the same blade shape is formed in the longitudinal direction, an energy-saving and quiet air conditioner 100 having a higher-efficiency and lower-noise cross-flow fan 8 mounted thereon can be obtained.

"Effect of Rib Shape"

(21) The ribs 14 and 16, which are each erected at a predetermined height toward the adjacent blade, are each formed so as to be substantially orthogonal to the impeller rotational axis and on the blade ring vicinity portion 8*ca* in the vicinity of the coupling portion 8*ce* between the blade ring vicinity portion 8*ca*, which is a portion in the vicinity of the ring 8*b*, and the inter-blade portion 8*cc* adjacent thereto in the impeller rotational axis direction in each of the blade pressure surfaces 13*a* and 13*b* of the blade. In the case where the rib is absent, the flow passing along the surfaces of the blade, which are adjacent to the coupling portion 8*ce* and have different blade cross sections, deviates in the impeller rotational axis direction and becomes unstable. Thus, the flow concentrates in a part of the regions to increase the airflow velocity, and in contrast, the flow tends to separate to decrease the airflow velocity and be disturbed. However, the airflow velocity can be equalized and the turbulence can be suppressed, and hence the noise of the cross-flow fan can be reduced and the motor input can be reduced due to the improvement of the air blowing efficiency. Thus, a quiet and energy-saving cross-flow fan and an air conditioner having the cross-flow fan mounted thereon can be obtained.

Figure 16:
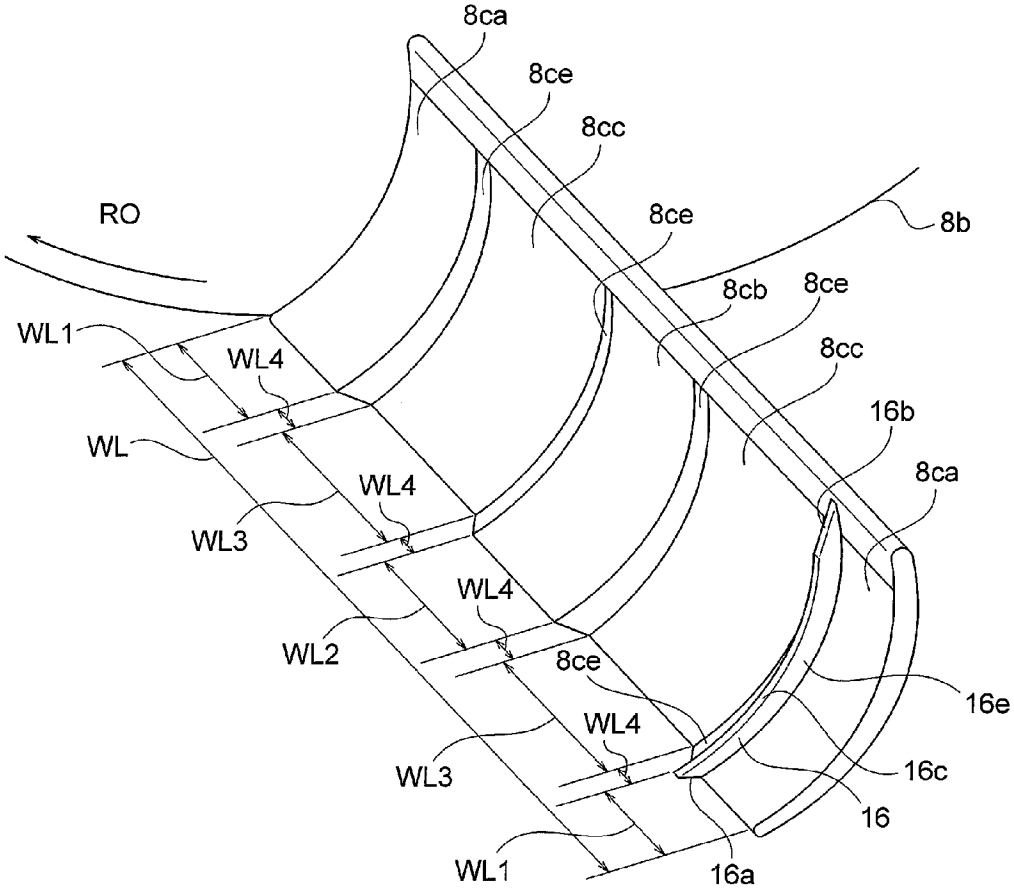
FIG. 16 is a perspective view corresponding to FIG. 4, which illustrates a case where the ribs are formed on the blade ring vicinity portion in the vicinity of the coupling portion on one side in the impeller rotational axis direction.
Figure 17:
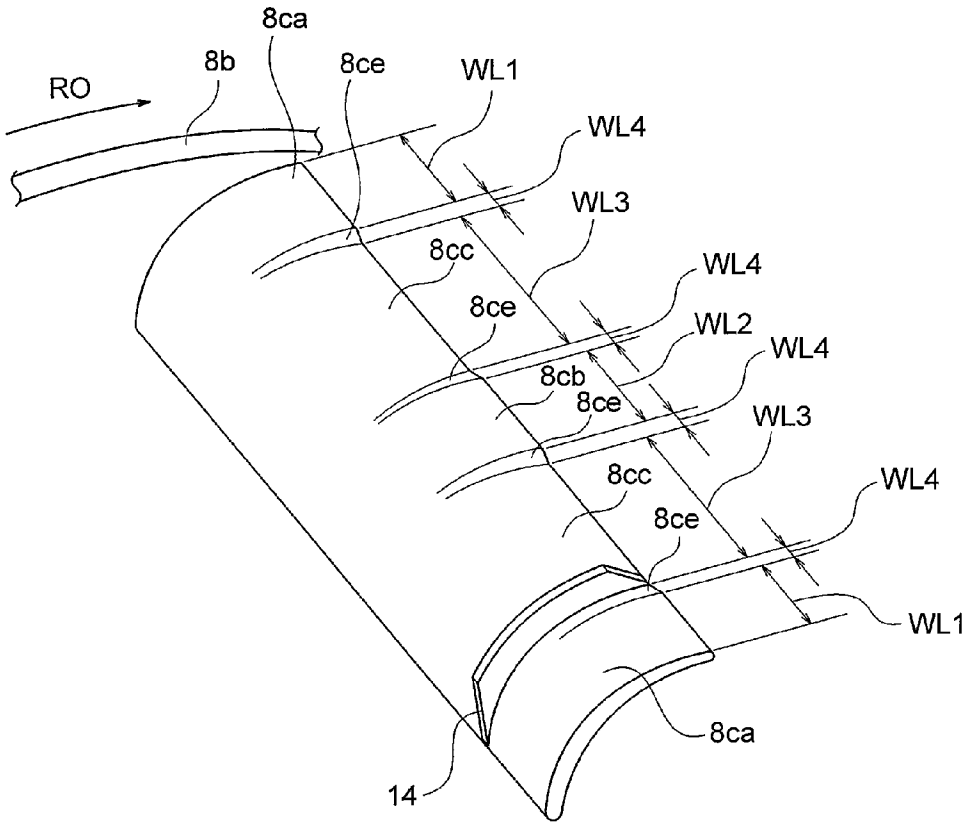
FIG. 17 is a perspective view corresponding to FIG. 5, which illustrates the case where the ribs are formed on the blade ring vicinity portion in the vicinity of the coupling portion on one side in the impeller rotational axis direction.

Note that, FIGS. 16 and 17 illustrate an example in which the ribs are formed on only one side in the impeller rotational axis direction. Even when the ribs are formed on only one side, the effect of the flow at the support plate and the blade ring vicinity portion can be obtained at least as compared to the case where the rib is absent.

Figure 18:
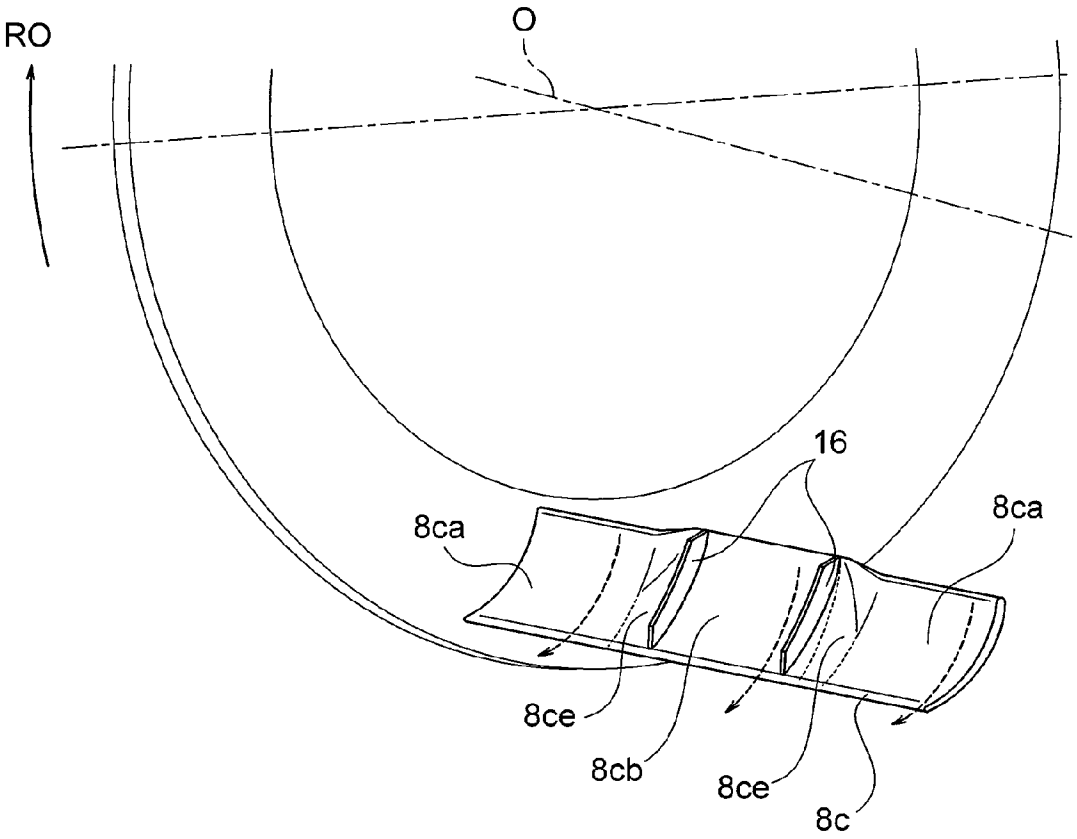
FIG. 18 is a perspective view corresponding to FIG. 4, which illustrates a case where the ribs are mounted to a blade having a blade cross section of another mode.

FIG. 18 illustrates another blade mode. In this mode, in the impeller element, the blade chord length of the blade ring center portion 8*cb* corresponding to the center portion in the rotational axis direction is larger than that of the blade ring vicinity portion 8*ca*. A part between those regions is formed so as to be connected by the coupling portion formed as an inclined surface whose shape gradually changes. Even in such a mode, an effect similar to that in the case of the above-mentioned basic mode can be obtained, and the effect can be obtained by forming the rib at least between the regions having different blade cross sections.

<Second Characteristic Effect>

Further, the coupling portion 8*ce* is formed as an inclined surface in which an adjacent blade sectional shape gradually changes. Therefore, the flow on the blade surface does not abruptly change in the impeller rotational axis direction, and hence no turbulence due to the level difference is caused. Further, stress concentration can be avoided. Therefore, there is no fear of blade damage, and the strength can be increased.

Further, a uniform airflow velocity distribution is achieved in the flow direction, and thus a local high airflow velocity region is eliminated. Therefore, the load torque is reduced, and hence the motor power consumption can be reduced. Further, no local high-velocity flow hits the airflow-direction vane arranged on the downstream side. Therefore, the ventilation resistance is reduced, and the load torque can be further reduced.

Further, the airflow velocity toward the airflow-direction vane is equalized, and a local high-velocity region is eliminated. Therefore, a noise due to boundary layer turbulence at the surface of the airflow-direction vane can be reduced.

As described above, the blade shape of the present invention enables prevention of separation and achievement of uniform airflow velocity distribution on both of the outer peripheral side and the inner peripheral side of the impeller. In this manner, a high-efficiency and low-noise cross-flow fan, and an air conditioner 100 having the energy-saving and quiet cross-flow fan 8 mounted thereon can be obtained.

<Third Characteristic Effect>

The rib is formed in a region between the outer diameter of the blade outer peripheral end portion and the inner diameter of the blade inner peripheral end portion. Therefore, a satisfactory workability can be secured although the rib is positioned on the outer peripheral side, and the rib does not disturb the inlet flow of the impeller, thereby reducing the noise. Further, also on the inner peripheral side, when the blade is rotated to pass through the impeller outlet region, the rib does not protrude on the inner peripheral side. Therefore, the flow on the entrance side of the blade is not disturbed, and hence the noise is reduced. Further, the rib is formed across both of the outer peripheral end portion and the inner peripheral end portion of the blade. Therefore, when the rib is installed only on the outer peripheral side or only on the inner peripheral side, such a phenomenon that the flow suddenly becomes unstable and the flow separates from the blade surface because the flow is not regulated by the rib on the downstream side on which the rib is absent can be suppressed. Thus, a low-noise cross-flow fan and an air conditioner having the cross-flow fan mounted thereon can be obtained.

<Fourth Characteristic Effect>

Figure 19:
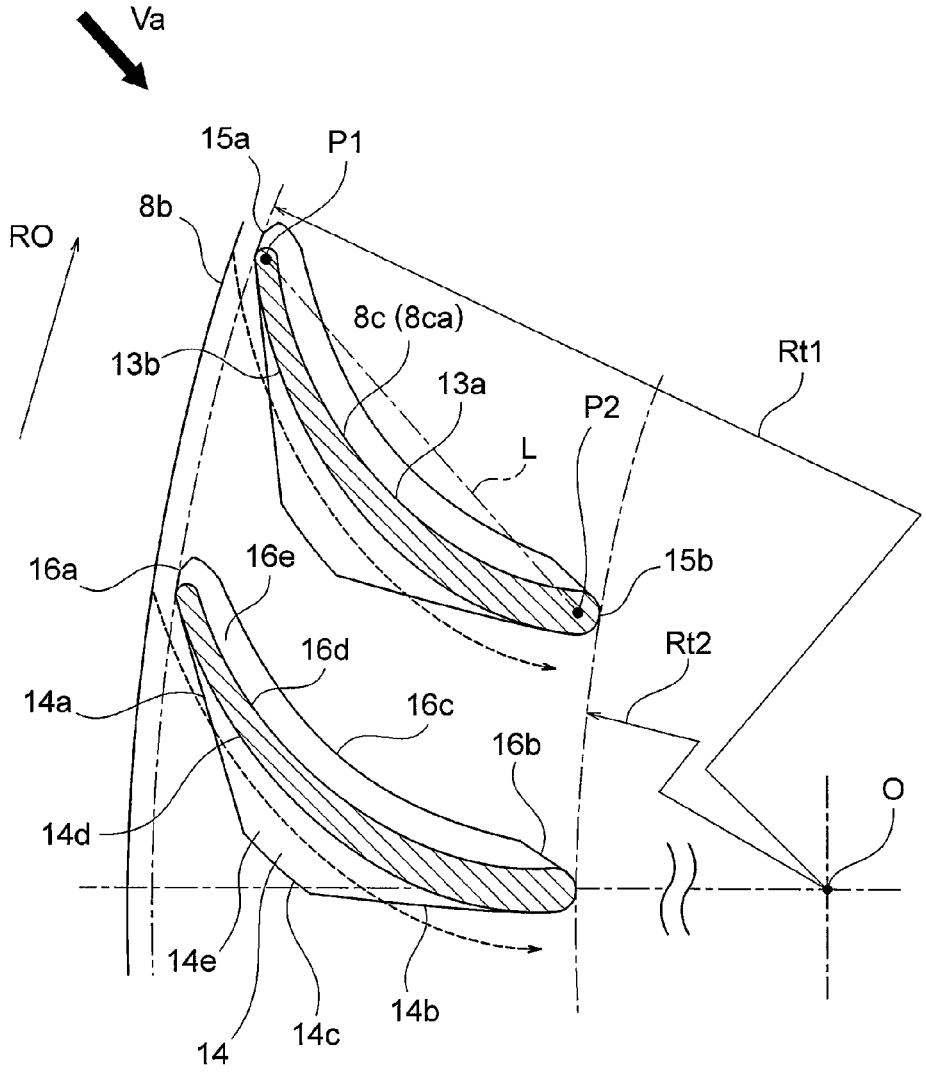
FIG. 19 is a view illustrating an example of a case where a rib side surface shape is formed into an end portion inclined shape that is tangent to an outer peripheral curved surface and an inner peripheral curved surface of the blade suction surface.

As a modified example of the rib, as illustrated in FIG. 19, in the region between the outer diameter of the blade outer peripheral end portion and the inner diameter of the blade inner peripheral end portion, the rib outer peripheral end portion 14*a* and the rib inner peripheral end portion 14*b* of the rib 14 on the blade suction surface side are respectively formed of inclined surfaces formed tangent to the arc-shaped blade outer peripheral end portion 15*a* and the arc-shaped blade inner peripheral end portion 15*b*, and the leading end of the rib 14 on the blade suction surface side is formed into an arc shape. In this case, when the flow comes into each of the rib outer peripheral end portion and the rib inner peripheral end portion, the collision of the flow is suppressed. Therefore, the development of the wake width toward the downstream side can be suppressed, and the turbulence can be suppressed, thereby reducing the noise. Thus, a low-noise cross-flow fan and an air conditioner having the cross-flow fan mounted thereon can be obtained.

<Fifth Characteristic Effect>

The thickness of the rib is equal to or more than the minimum thickness of the blade and equal to or less than the maximum thickness of the blade. Therefore, it is possible to prevent deterioration in resin running in a molding die during resin molding due to the thickness smaller than the minimum thickness, or prevent generation of sink marks due to the thickness larger than the maximum thickness. Therefore, the molding performance is increased, and the change in blower performance due to the shape fluctuation can be decreased. Thus, a high-quality cross-flow fan and an air conditioner having the cross-flow fan mounted thereon can be obtained.

<Sixth Characteristic Effect>

The thickness of the rib is tapered toward the leading end from the blade surface, and the leading ends on the outer peripheral side and the inner peripheral side of the blade have an arc shape. Therefore, when the die is released in molding, there is no fear of damage due to biting of the blade into the die, and thus the molding performance is increased. Further, the leading end has an arc shape instead of an edge shape. Therefore, when the cross-flow fan is cleaned, the worker does not need to be excessively nervous because no sharp edge is present. Thus, a satisfactory workability is secured. Further, when the flow comes in, the flow smoothly comes in, and hence the turbulence does not occur and the noise can be reduced. Thus, a low-noise cross-flow fan having high manufacturability and high safeness, and an air conditioner having the cross-flow fan mounted thereon can be obtained.

<Seventh Characteristic Effect>

Further, the height of the rib is at least equal to or less than a half of the pitch of the adjacent blades. Therefore, in a case where the ribs are arranged on both of the pressure surface and the suction surface of the blade, when the ribs are installed at the same position in the rotational axis direction of the impeller, the ribs do not interfere with each other, and there is no fear of damage. Further, when those ribs are each installed in the vicinity of the coupling portion at positions different in the rotational axis direction, it is possible to prevent generation of the abnormal fluid noise caused by a local high passage airflow velocity due to the narrowed gap between the ribs, and the quality is maintained. Thus, a high-quality cross-flow fan and an air conditioner having the cross-flow fan mounted thereon can be obtained.

<Eighth Characteristic Effect>

The blade suction surface on the opposite side to the impeller rotational direction side of the blade surface tends to cause an unstable flow as compared to the blade pressure surface. In this blade suction surface, the flow passing along the surfaces of the blade, which are adjacent to the coupling portion and have different blade cross sections, deviates in the impeller rotational axis direction and becomes unstable. Thus, the flow concentrates in a part of the regions to increase the airflow velocity, and in contrast, the flow tends to separate to decrease the airflow velocity and be disturbed. However, in this embodiment, the rib is formed on the blade suction surface, and hence the airflow velocity can be equalized and the turbulence can be suppressed with the rib.

<Ninth Characteristic Effect>

Further, when the rib is formed on the blade pressure surface on the impeller rotational direction side of the blade surface, in a region between adjacent blades, such a phenomenon that the flow moves from the advancing region to the retreating region in the impeller rotational direction is suppressed, and the flow is guided in each region in a direction orthogonal to the impeller rotational axis. Therefore, a stable flow can be formed without inhibiting the pressure rise. Thus, the air blowing efficiency is increased, and the fan motor input is reduced. Further, an energy-saving cross-flow fan and an air conditioner having the cross-flow fan mounted thereon can be obtained.

<Tenth Characteristic Effect>

When the ribs are formed on both of the impeller rotational direction side (blade pressure surface side) and an opposite side to the impeller rotational direction side (blade suction surface side) of the blade surface, in the blade suction surface, such an unstable flow phenomenon that the flow passing along the surfaces of the blade, which are adjacent to the coupling portion and have different blade cross sections, deviates in the impeller rotational axis direction is suppressed. Further, in both of the blade suction surface and the blade pressure surface, in the region between the adjacent blades, such a phenomenon that the flow moves from the advancing region to the retreating region in the impeller rotational direction is suppressed, and the flow is guided in each region in the direction orthogonal to the impeller rotational axis. Therefore, a stable flow can be formed without inhibiting the pressure rise. Further, the ribs are formed on both the blade surfaces, and further the space between the support plate and the rib is partitioned. Thus, an inter-blade flow path is separately formed in the vicinity of the support plate. Therefore, the flow is regulated, and the unstable phenomenon is suppressed. Thus, the air blowing efficiency is increased, and the fan motor input is reduced, thereby suppressing the pressure fluctuation due to the unstable phenomenon. As a result, an energy-saving and low-noise cross-flow fan and an air conditioner having the cross-flow fan mounted thereon can be obtained.

<Eleventh Characteristic Effect>

The heights of the ribs formed on both of the impeller rotational direction side and the opposite side to the impeller rotational direction side of the blade surface are formed so that the height of the rib on the opposite side to the impeller rotational direction side surface (blade suction surface side) is formed larger than that of the rib on the impeller rotational direction side (blade pressure surface side). That is, by forming the rib on the blade suction surface side, which is more liable to cause unstable flow, higher, an unstable flow is regulated. With this, simultaneously, the height of the rib is reduced on the blade pressure surface, which is originally liable to form a flow in the blade chord direction orthogonal to the rotational axis in the blade surface. Thus, the interference of the flow can be suppressed, and an abnormal fluid noise caused by a high-velocity flow at the gap between excessively approaching ribs can be suppressed. Therefore, a quiet cross-flow fan having a smooth audibility and an air conditioner having the cross-flow fan mounted thereon can be obtained.

<Twelfth Characteristic Effect>

Further, the ribs are formed at positions different in the impeller rotational axis direction between the pressure surface and the suction surface of the blade. The blade sectional shape of the impeller is formed so that the advancing region, which forms a protruding shape in the rotational direction, and the retreating region, which forms a recessed shape in the rotational direction, alternately appear when viewed in the impeller rotational axis direction. Further, a region between the advancing region and the retreating region is connected by the coupling portion. When the ribs are installed on such a blade shape, the ribs are shaped different between the pressure surface and the suction surface of the blade. On both of the pressure surface side and the suction surface side of the blade, the rib is formed on the coupling portion or on the advancing region in the vicinity of the coupling portion. With this, in the blade pressure surface and the blade suction surface, a flow from the advancing region having a high pressure to the retreating region having a relatively low pressure can be suppressed. In addition, in the blade suction surface, the rib is formed so as to be connected to the blade surface at an obtuse angle. Thus, local narrowing of the space can be suppressed, and local increase in velocity of a flow at this position is suppressed. With this, a uniform airflow velocity distribution can be achieved. As a result, the noise is reduced, and the air blowing efficiency can be increased due to suppression in flow leakage. Thus, a low-noise and high-efficiency cross-flow fan and an air conditioner having the cross-flow fan mounted thereon can be obtained.

<Thirteenth Characteristic Effect>

As a method of molding the blade, there are known a method of releasing the molding die by moving the die radially in the impeller diameter direction, and a method of releasing the molding die by rotating the die in the impeller rotational direction and then moving the die in the impeller diameter direction. Both of the methods have a restriction in terms of shape such that the blade end portion is shaped as an edge in order to move the molding die. Such a restriction may cause easy separation of the flow on the blade, which causes a problem of generation of noise as a result. In contrast, in this embodiment, the impeller is formed as follows. The blades and the support plates are individually molded. On both surfaces of the support plate on the outer peripheral side, groove portions for inserting and fixing the blades are formed. Then, the plurality of blades are inserted and fixed to the support plates. Therefore, molding is possible without causing the problem in the related art described above, which enables free design, higher efficiency, and lower noise. Thus, a low-noise and high-efficiency cross-flow fan and an air conditioner having the cross-flow fan mounted thereon can be obtained.

<Fourteenth Characteristic Effect>

When the above-mentioned cross-flow fan in which the ribs are formed on the blade surfaces is mounted on the air conditioner, a high-efficiency, low-noise, and high-quality air conditioner can be obtained.

The details of the present invention have been described above specifically with reference to the preferred embodiments, it is apparent that a person skilled in the art may employ various modifications based on the basic technical thoughts and teachings of the present invention.

The present invention is widely applicable to an apparatus including a ventilation resistor such as a heat exchanger and an air cleaning filter, an impeller, a stabilizer for separating an inlet-side flow path and an outlet-side flow path, and a helical guide wall formed on the outlet side of the impeller. Thus, the motor input can be reduced, the abnormal fluid noise due to the blade surface separation can be reduced, the noise level can be reduced, and the safeness can be improved. As a result, a high-efficiency, energy-saving, good-audibility, low-noise, quiet, and high-quality air conditioner capable of preventing dew condensation on the impeller and discharging the dew condensation water to the outside can be obtained. Further, the present invention may be embodied as a mode in which the above-mentioned rib is formed on only one of the pressure surface and the suction surface of the blade.

REFERENCE SIGNS LIST

1 main body, 5 filter (ventilation resistor), 7 heat exchanger (ventilation resistor), 8 cross-flow fan, 8*a* impeller, 8*b* ring (support plate), 8*ba* groove, 8*c* blade, 8*ca* blade ring vicinity portion (first region), 8*cb* blade ring center portion (second region), 8*cc* inter-blade portion (third region), 8*ce* coupling portion, 8*f* fan shaft, 9 stabilizer, 10 guide wall, 12*a* motor shaft, 13*a* blade pressure surface, 13*b* blade suction surface, 14 rib, 14*a* rib outer peripheral end portion, 14*b* rib inner peripheral end portion, 15*a* blade outer peripheral end portion, 15*b* blade inner peripheral end portion, 16 rib, 16*a* rib outer peripheral end portion, 16*b* rib inner peripheral end portion, 100 air conditioner.

The invention claimed is:

1. A cross-flow fan, comprising:

an impeller; and a shaft supporting the impeller in a rotatable manner, the impeller comprising:

a plurality of support plates; and a plurality of blades arranged at intervals in a circumferential direction between a corresponding pair of the plurality of support plates, each of the plurality of blades comprising a plurality of regions different in a blade cross section orthogonal to an impeller rotational axis, the plurality of regions being arranged in a direction of the impeller rotational axis in the blade, each of the plurality of blades further comprising a coupling portion for coupling the plurality of regions to each other, each of the plurality of blades comprising at least one rib formed on the coupling portion or a region adjacent to the coupling portion, wherein:

the rib has a rib outer peripheral end portion and a rib inner peripheral end portion that are inclined surfaces formed tangent to an arc-shaped blade outer peripheral end portion and an arc-shaped blade inner peripheral end portion, respectively; and the rib outer peripheral end portion and the rib inner peripheral end portion each have a leading end formed into an arc shape.

2. The cross-flow fan according to claim 1, wherein:

the blade comprises, as the plurality of regions, at least one pair of first regions, a second region, and at least one pair of third regions;

each of the first regions is a part adjacent to the support plate in a state in which the impeller is formed;

the second region is a part positioned between a corresponding pair of the first regions;

each of the third regions is positioned between the corresponding pair of the first regions and between the second region and the corresponding first region;

the first region and the third region are each coupled to each other by the coupling portion, and the second region and the third region are each coupled to each other by the coupling portion; and the first region, the second region, and the third region have different blade outlet angles from each other.

3. The cross-flow fan according to claim 1, wherein the coupling portion is formed as an inclined surface in which a blade sectional shape of the corresponding and adjacent region gradually changes.

4. The cross-flow fan according to claim 1, wherein the rib is formed in a region between an outer diameter of a blade outer peripheral end portion and an inner diameter of a blade inner peripheral end portion.

5. The cross-flow fan according to claim 1, wherein the rib has a thickness that is equal to or more than a minimum thickness of the blade and equal to or less than a maximum thickness of the blade.

6. The cross-flow fan according to claim 1, wherein the rib is formed on at least a blade suction surface in a blade surface, which is positioned on an opposite side to an impeller rotational direction side.

7. An air conditioner, comprising:

a stabilizer for partitioning an inlet-side air duct and an outlet-side air duct inside a main body;

a cross-flow fan arranged between the inlet-side air duct and the outlet-side air duct;

a ventilation resistor arranged inside the main body; and a guide wall for guiding air discharged from the cross-flow fan to an air outlet of the main body, the cross-flow fan comprising the cross-flow fan of claim 1.

8. A cross-flow fan, comprising:

an impeller; and a shaft supporting the impeller in a rotatable manner, the impeller comprising:

a plurality of support plates; and a plurality of blades arranged at intervals in a circumferential direction between a corresponding pair of the plurality of support plates, each of the plurality of blades comprising a plurality of regions different in a blade cross section orthogonal to an impeller rotational axis, the plurality of regions being arranged in a direction of the impeller rotational axis in the blade, each of the plurality of blades further comprising a coupling portion for coupling the plurality of regions to each other, each of the plurality of blades comprising at least one rib formed on the coupling portion or a region adjacent to the coupling portion, wherein:

the rib has a thickness formed into a tapered shape from a blade surface toward a leading end; and the rib outer peripheral end portion and the rib inner peripheral end portion each have a leading end formed into an arc shape.

9. A cross-flow fan, comprising:

an impeller; and a shaft supporting the impeller in a rotatable manner, the impeller comprising:

a plurality of support plates; and a plurality of blades arranged at intervals in a circumferential direction between a corresponding pair of the plurality of support plates, each of the plurality of blades comprising a plurality of regions different in a blade cross section orthogonal to an impeller rotational axis, the plurality of regions being arranged in a direction of the impeller rotational axis in the blade, each of the plurality of blades further comprising a coupling portion for coupling the plurality of regions to each other, each of the plurality of blades comprising at least one rib formed on the coupling portion or a region adjacent to the coupling portion, wherein the rib has a rib height that is equal to or less than half a pitch of adjacent blades.

10. A cross-flow fan, comprising:

an impeller; and a shaft supporting the impeller in a rotatable manner, the impeller comprising:

a plurality of support plates; and a plurality of blades arranged at intervals in a circumferential direction between a corresponding pair of the plurality of support plates, each of the plurality of blades comprising a plurality of regions different in a blade cross section orthogonal to an impeller rotational axis, the plurality of regions being arranged in a direction of the impeller rotational axis in the blade, each of the plurality of blades further comprising a coupling portion for coupling the plurality of regions to each other, each of the plurality of blades comprising at least one rib formed on the coupling portion or a region adjacent to the coupling portion, wherein the rib is formed on at least a blade pressure surface on an impeller rotational direction side in the blade surface.

11. A cross-flow fan, comprising:

an impeller; and a shaft supporting the impeller in a rotatable manner, the impeller comprising:

a plurality of support plates; and a plurality of blades arranged at intervals in a circumferential direction between a corresponding pair of the plurality of support plates, each of the plurality of blades comprising a plurality of regions different in a blade cross section orthogonal to an impeller rotational axis, the plurality of regions being arranged in a direction of the impeller rotational axis in the blade, each of the plurality of blades further comprising a coupling portion for coupling the plurality of regions to each other, each of the plurality of blades comprising at least one rib formed on the coupling portion or a region adjacent to the coupling portion, wherein the rib is formed on, in a blade surface, both of a blade suction surface positioned on the opposite side to the impeller rotational direction side and a blade pressure surface positioned on the impeller rotational direction side.

12. The cross-flow fan according to claim 11, wherein the rib, which is formed on the blade suction surface, has a height that is larger than a height of the rib, which is formed on the blade pressure surface.

13. The cross-flow fan according to claim 11, wherein the rib, which is formed on the blade suction surface, and the rib, which is formed on the blade pressure surface, are formed at positions different from each other in the direction of the impeller rotational axis.

14. A cross-flow fan, comprising:

an impeller; and a shaft supporting the impeller in a rotatable manner, the impeller comprising:

a plurality of support plates; and a plurality of blades arranged at intervals in a circumferential direction between a corresponding pair of the plurality of support plates, each of the plurality of blades comprising a plurality of regions different in a blade cross section orthogonal to an impeller rotational axis, the plurality of regions being arranged in a direction of the impeller rotational axis in the blade, each of the plurality of blades further comprising a coupling portion for coupling the plurality of regions to each other, each of the plurality of blades comprising at least one rib formed on the coupling portion or a region adjacent to the coupling portion, wherein:

the plurality of support plates and the plurality of blades are individually molded;

the support plate has a side surface formed with groove portions for inserting therein the corresponding plurality of blades; and the impeller is constructed in a mode in which the plurality of blades are inserted and fixed to the corresponding groove portions.

* * * * *